US006628049B2

(12) United States Patent
Rosenthal et al.

(10) Patent No.: US 6,628,049 B2
(45) Date of Patent: Sep. 30, 2003

(54) SPARK PLUG WITH SIMULTANEOUSLY MULTI-FIRING CAP

(75) Inventors: Bert Rosenthal, Encino, CA (US); Robert Schaus, La Quinta, CA (US)

(73) Assignee: Pyrostars, LLC, Van Nuys, CA (US)

( * ) Notice: Subject to any disclaimer, the term of this patent is extended or adjusted under 35 U.S.C. 154(b) by 44 days.

(21) Appl. No.: 09/776,624

(22) Filed: Feb. 2, 2001

(65) Prior Publication Data

US 2002/0145371 A1 Oct. 10, 2002

(51) Int. Cl.[7] ..... H01T 13/20
(52) U.S. Cl. ..... 313/141
(58) Field of Search ..... 65/32.2, 59.31, 65/59.35; 313/123, 135, 139, 140, 141, 142; 445/7

(56) References Cited

U.S. PATENT DOCUMENTS

| | | | | |
|---|---|---|---|---|
| 1,538,580 A | | 5/1925 | O'Brien | |
| 1,610,032 A | * | 12/1926 | Beason | 313/141 |
| 1,661,405 A | | 3/1928 | Broluska | |
| 3,958,144 A | | 5/1976 | Franks | |
| 4,401,915 A | | 8/1983 | Kashiwara et al. | |
| 4,808,878 A | | 2/1989 | Kashiwara et al. | |
| 5,007,389 A | | 4/1991 | Kashiwara et al. | |
| 5,090,373 A | | 2/1992 | Kashiwara et al. | |
| 5,107,168 A | | 4/1992 | Friedrich et al. | |
| 5,144,188 A | | 9/1992 | Kagawa et al. | |
| 5,280,214 A | | 1/1994 | Johnson | |
| 5,430,346 A | | 7/1995 | Johnson | |
| 5,623,179 A | | 4/1997 | Buhl | |
| 5,731,655 A | | 3/1998 | Corrado | |
| 5,767,613 A | | 6/1998 | Kunt | |
| 5,821,676 A | | 10/1998 | Atchinson, II et al. | |
| 6,080,029 A | | 6/2000 | Johnson et al. | |
| 6,121,720 A | * | 9/2000 | Rossi | 313/141 |

FOREIGN PATENT DOCUMENTS

| | | |
|---|---|---|
| DE | 3728161 | 3/1989 |
| DE | 3828805 | 3/1990 |
| DE | 19637374 | 3/1998 |
| GB | 242222 | 4/1925 |
| GB | 2327459 | 1/1999 |
| WO | 9200620 | 1/1992 |
| WO | 9904469 | 1/1999 |

* cited by examiner

*Primary Examiner*—Hoang Ngo
(74) *Attorney, Agent, or Firm*—Pillsbury Winthrop LLP

(57) ABSTRACT

The invention is a spark plug having a novel cap attached to an end of the spark plug's central electrode, as well as a cylindrical extension attached to the outer shell of the spark plug. The cap is generally concave and star-shaped, with a plurality of projections protruding from the periphery of the cap, wherein the cap includes a thick central dome, and thins out in a radial direction towards the protruding projections. The cap, the central electrode, and the cylindrical extension are all made of a novel alloy which, in conjunction with their novel structure, allow for the simultaneous generation of a spark from every single projection on the cap. Such simultaneous, multi-spark generation provides a more rapid and complete combustion of the air-fuel mixture within the cylinder of an engine, which, in turn, results in increased torque as well as reduced emissions from the engine.

15 Claims, 43 Drawing Sheets

SPARK PLUG WITH SIMULTANEOUSLY MULTI-FIRING CAP

BACKGROUND OF THE INVENTION

1. Field of the Invention

The present invention relates to the field of spark generation in internal combustion engines and, more specifically, to a novel spark plug with a ground collar, firing ring, and capped central electrode which are made of a novel alloy to produce multiple, simultaneous, sparks from multiple locations around the periphery of the cap.

2. Art Background

In internal combustion engines, the spark plug serves as the spark-generation source which fires at pre-determined intervals in order to ignite the air-fuel mixture within a given cylinder of the engine. Spark plugs of conventional design typically comprise a concentric arrangement of three structural elements: (1) a central electrode; (2) an insulator, such as a ceramic jacket, that surrounds the periphery of the central electrode; and (3) an outer shell, including an outer ground electrode, that surrounds the periphery of the insulator.

The central electrode is in the shape of a solid cylindrical pin, with proximal and distal ends that project axially from either end of the spark plug. In addition, a portion of the outer shell is threaded, wherein the threaded portion mates with a corresponding threaded portion in the engine head above the cylinder to create a tight fit between the engine head and the spark plug. Once the spark plug has been threaded into position in this manner, the proximal end of the central electrode projects axially out of the spark plug body and into the cylinder, while the distal end projects out of the spark plug and in a direction opposite the proximal end.

In operation, the central electrode is adapted to receive an electrical charge at its distal end, which charge is then conducted forward to the proximal end of the electrode, inside the cylinder. Given the construction of the spark plug, an electrical gap exists between the proximal end of the central electrode, on the one hand, and the proximal end of the ground electrode, on the other. As such, the electrical charge that is applied to the distal end of the central electrode must be sufficiently large to "jump" the gap and create a spark at the appropriate moment in time (e.g., during the latter portion of the compression cycle of the piston within the cylinder). The spark generated then ignites the pressurized air-fuel mixture within the cylinder which, in turn, causes the piston to repel, thus producing mechanical energy.

As can be seen from the brief description presented above, the performance of a given engine depends, to a great extent, on the structure, material composition, and proper operation of the spark plug. For example, depending on the materials used to manufacture the central and ground electrodes, the spark plug may be more prone to fouling (i.e., build-up of Carbon) than is desirable. Fouling, in turn, adversely affects not only the longevity and operation of the spark plug, but also the efficiency of the engine. In addition, considering the range of high operating temperatures in a typical engine cylinder (e.g., 900° F. to 2200° F.), the material make-up of the spark plug determines the type of engine in which a given spark plug may be used without running the risk of compromising its structural integrity.

The materials used also affect the useful life of the plug for that engine. Moreover, it has been determined that spark generation across a gap is achieved more easily from sharp edges and/or tips on the proximal end of the central electrode. In this regard, the material composition of the central electrode determines the speed with which wear (i.e., rounding of edges) occurs in a given spark plug. Depending on the extent of wear on an electrode, the spark plug may misfire (i.e., be delayed in firing), which will directly affect engine efficiency and emissions.

As was mentioned previously, in order for an engine to operate properly and efficiently, the plug must produce a spark during a time window towards the end of the compression stroke of the piston within the engine cylinder. If the spark is generated at a point that is outside of this time window, combustion will take place either prematurely or too late. As a consequence, the fuel-air mixture will burn only partially, which will adversely affect not only fuel efficiency, but also power generation and the production, retention, and release of harmful emissions. As such, it is imperative that the spark plug fire in a manner that is temporally synchronous with the cyclical operation of the engine cylinder. In addition, the more (spatially) uniform the spark generation, the more efficient and complete the combustion within the cylinder.

Attempts have been made to address some of the concerns mentioned above by, e.g., attaching an enlarged tip, or cap, to the proximal end of the central electrode (see, e.g., U.S. Pat. Nos. 5,767,613 and 5,731,655), attaching an L-shaped, or other similar extension, to the ground electrode to provide various gap sizes and geometries (see, e.g., U.S. Pat. Nos. 5,280,214 and 5,821,676), attaching annular rings, or cylindrical extensions having holes through the wall thereof, to the spark plug outer shell (see, e.g., U.S. Pat. Nos. 3,958,144 and 5,623,179), and employing metal alloys including Nickel and/or Platinum in the composition of the electrode material in an attempt to increase the useful life of the spark plug (see, e.g., U.S. Pat. No. 5,107,168).

However, there is still a need for a spark plug that offers structural integrity and longevity while, at the same time, providing for increased engine efficiency and reduced emissions as byproducts of the combustion process. This invention satisfies these and other needs.

DETAILED DESCRIPTION OF THE INVENTION

The invention is a spark plug having a novel cap attached to an end of the plug's central electrode, as well as a cylindrical extension attached to the outer shell of the spark plug. The cap is generally concave and star-shaped, with a plurality of projections protruding from the periphery of the cap. As will be described in more detail below, the novel structure and material composition of the cap and cylindrical extension allow for the simultaneous generation of a spark from every projection on the cap. Such simultaneous, multi-spark generation provides a more rapid and complete combustion of the air-fuel mixture within the cylinder of an engine, which, in turn, results in increased torque as well as reduced emissions from the engine.

Figure 1:
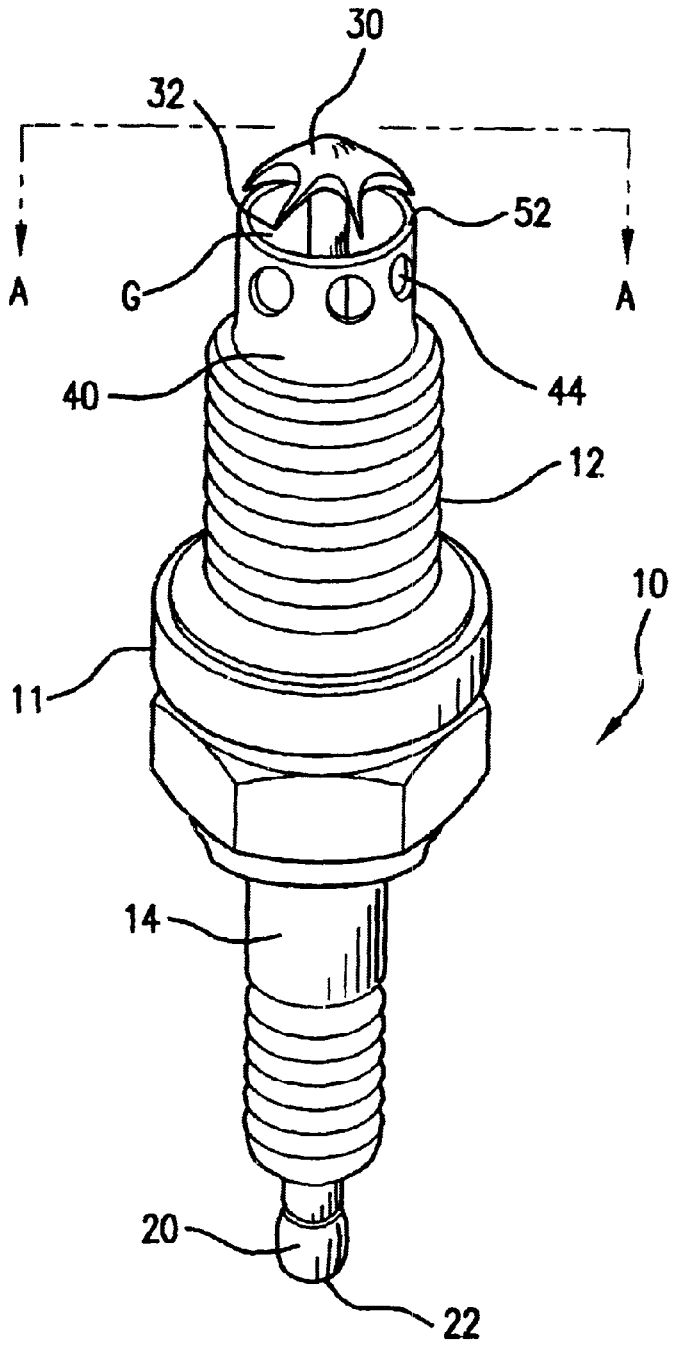
FIG. 1 is a side elevational view of an embodiment of the invention.
Figure 2:
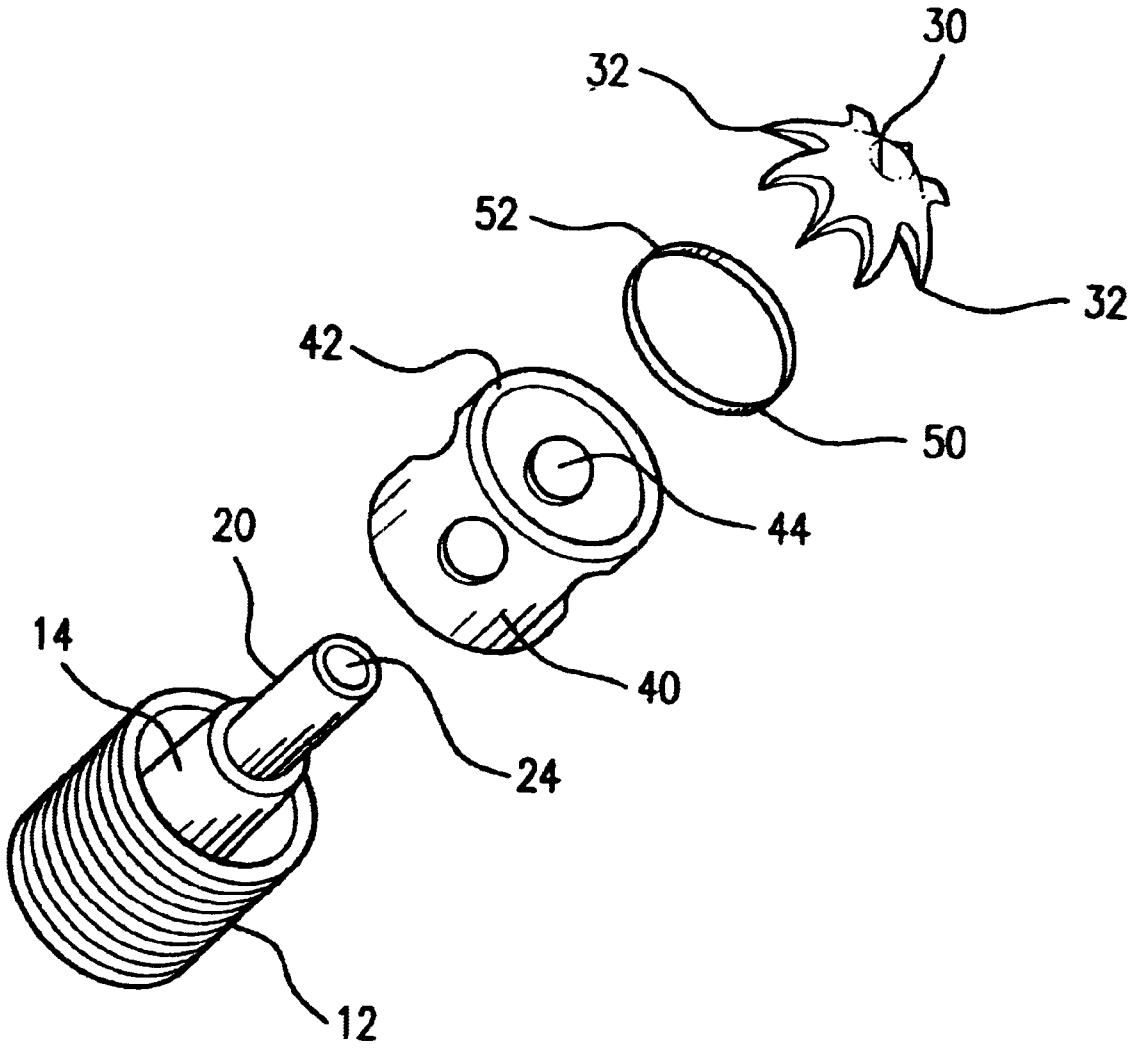
FIG. 2 is an exploded view of the upper portion of the embodiment shown in FIG. 1.
Figure 3:
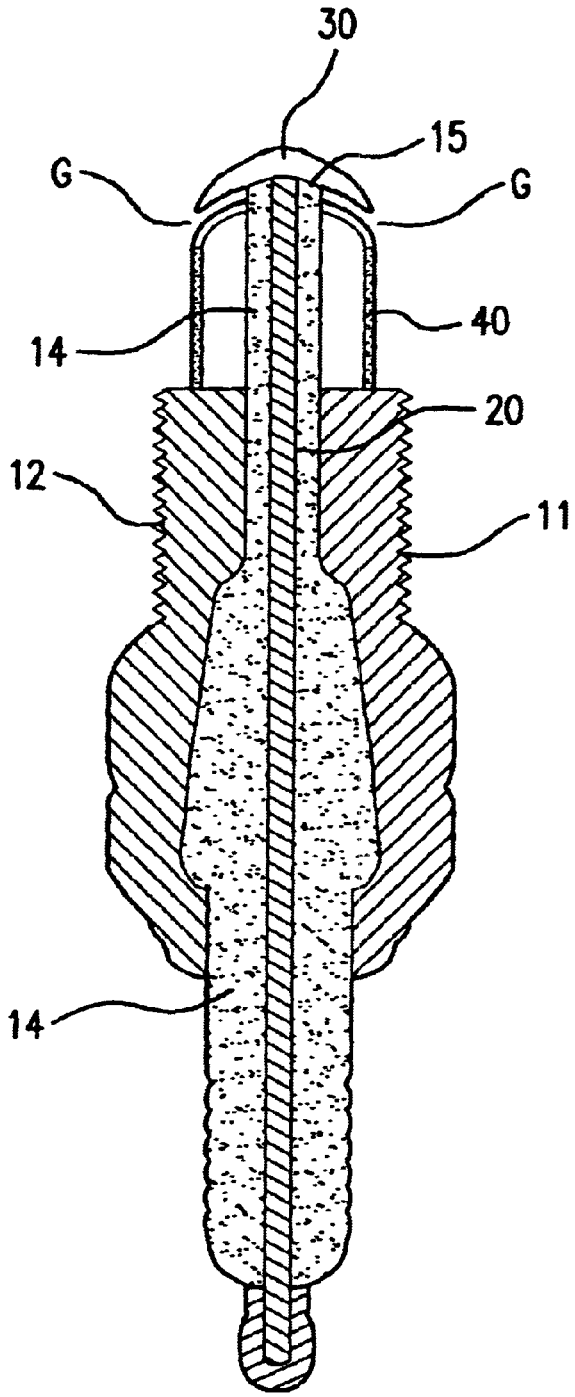
FIG. 3 is a sectional view along line A—A of the embodiment shown in FIG. 1.
Figure 4:
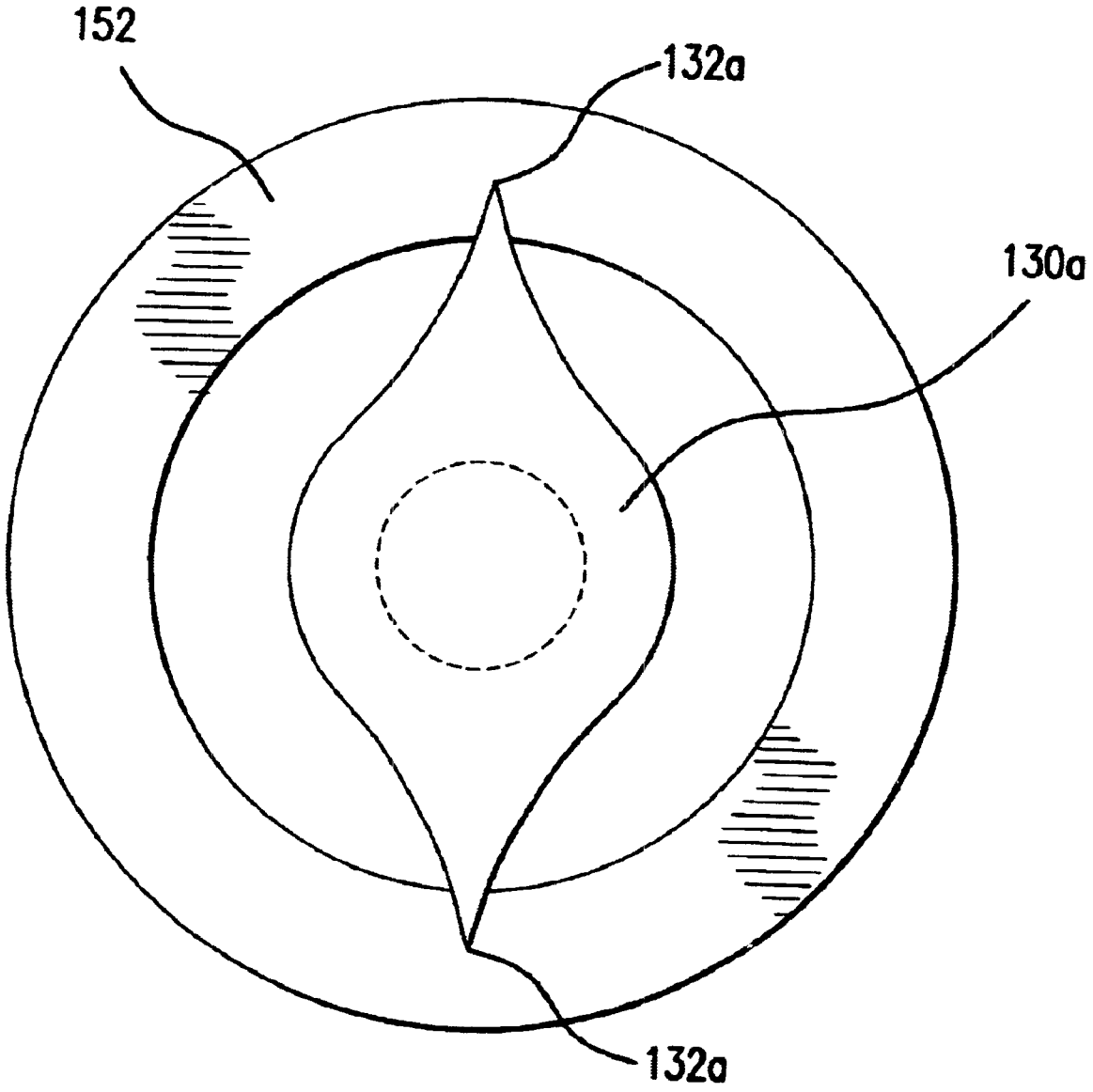
FIG. 4 is an enlarged top view of an embodiment of the invention.
Figure 5:
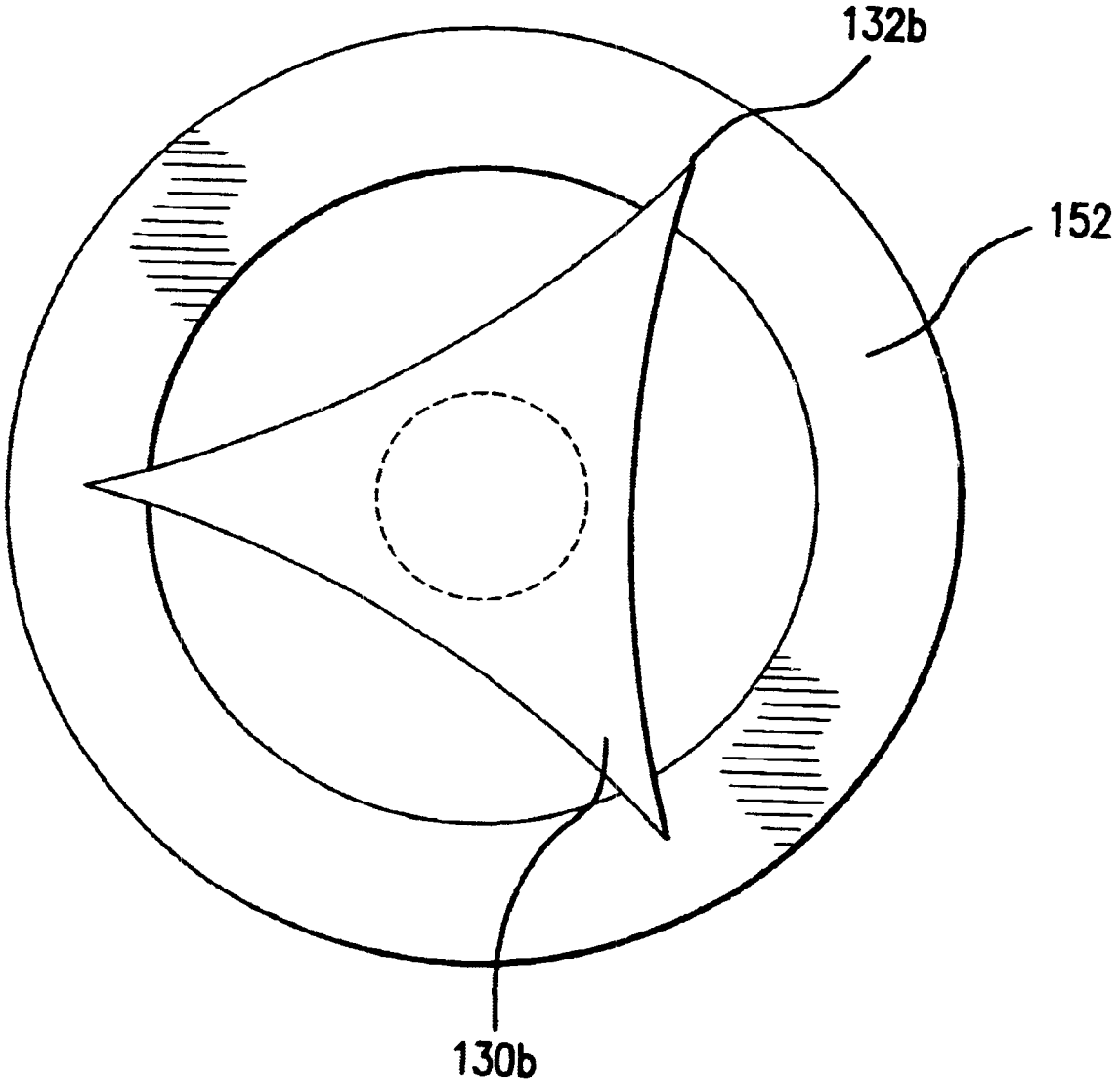
FIGS. 5–14 show variations of the embodiment of the invention shown in FIG. 4, wherein the cap has, respectively, between three and twelve tips.
Figure 6:
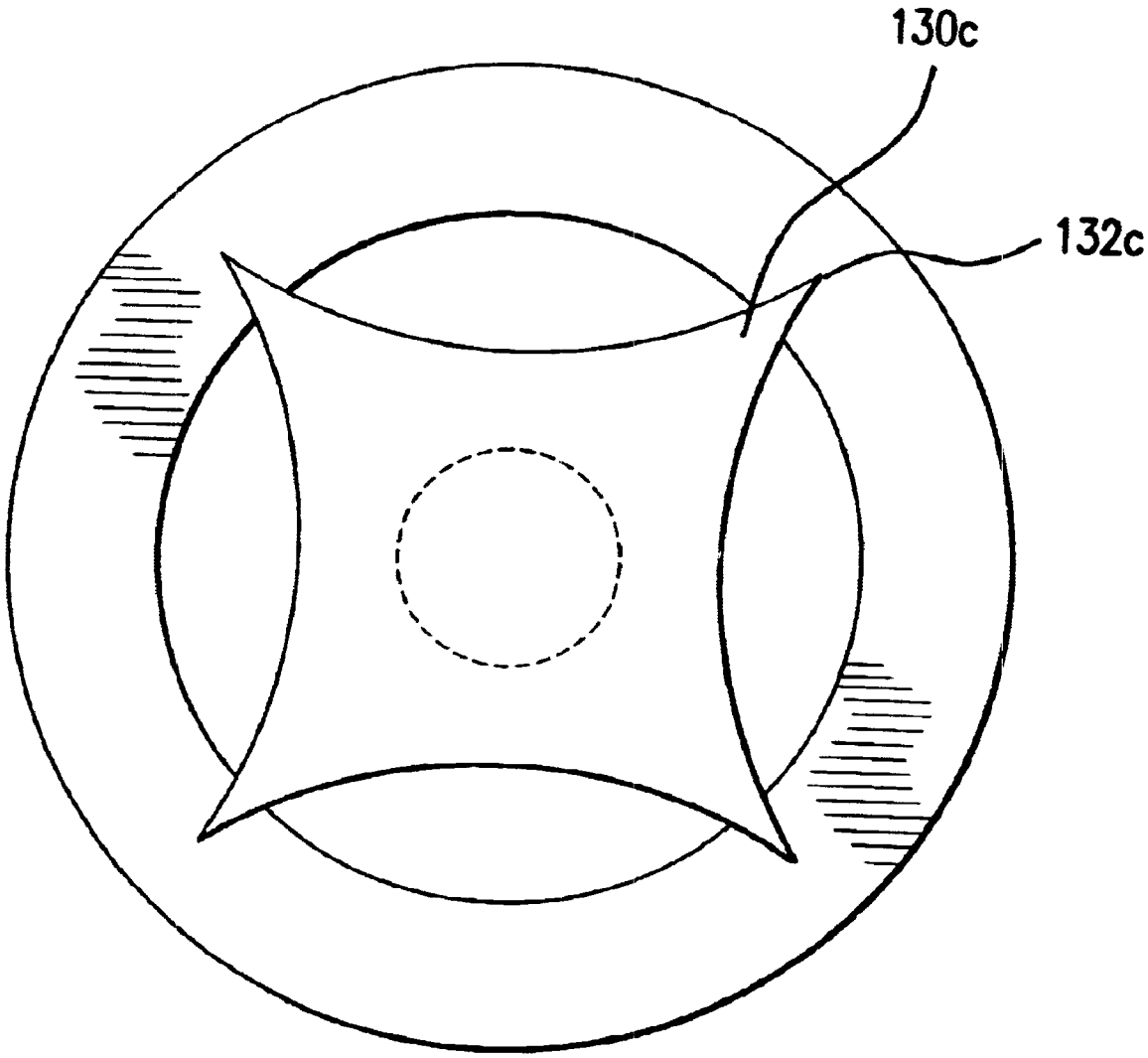
Figure 7:
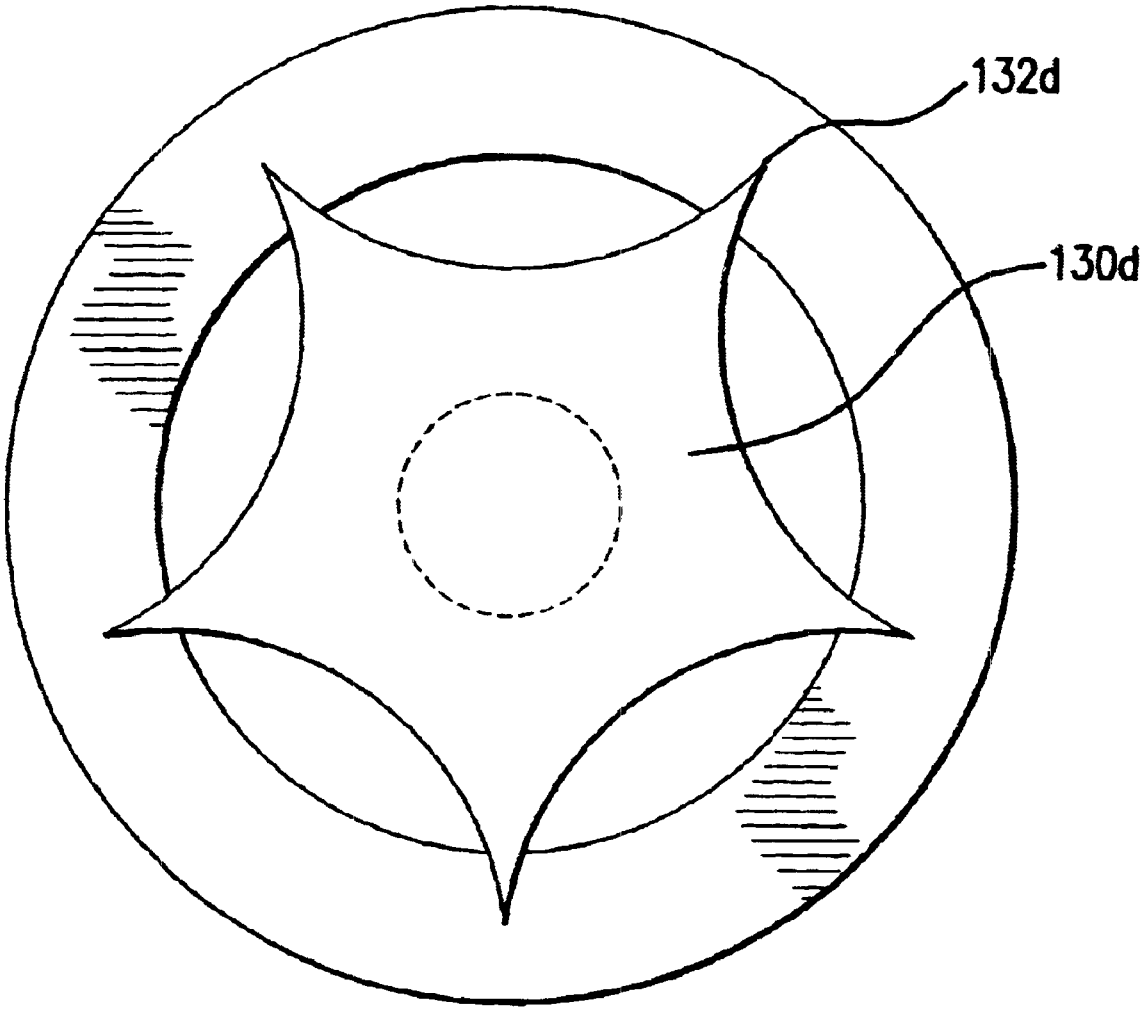
Figure 8:
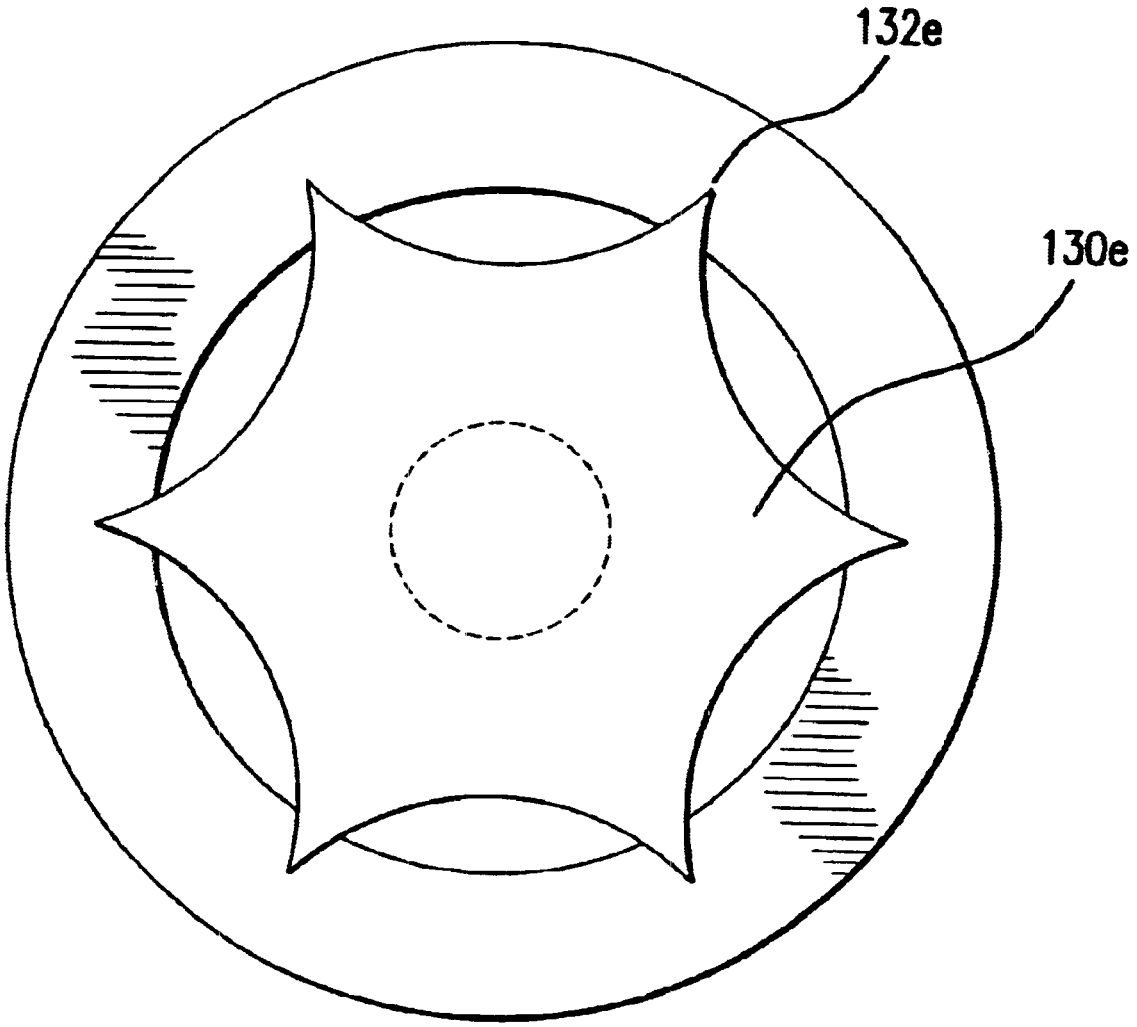
Figure 9:
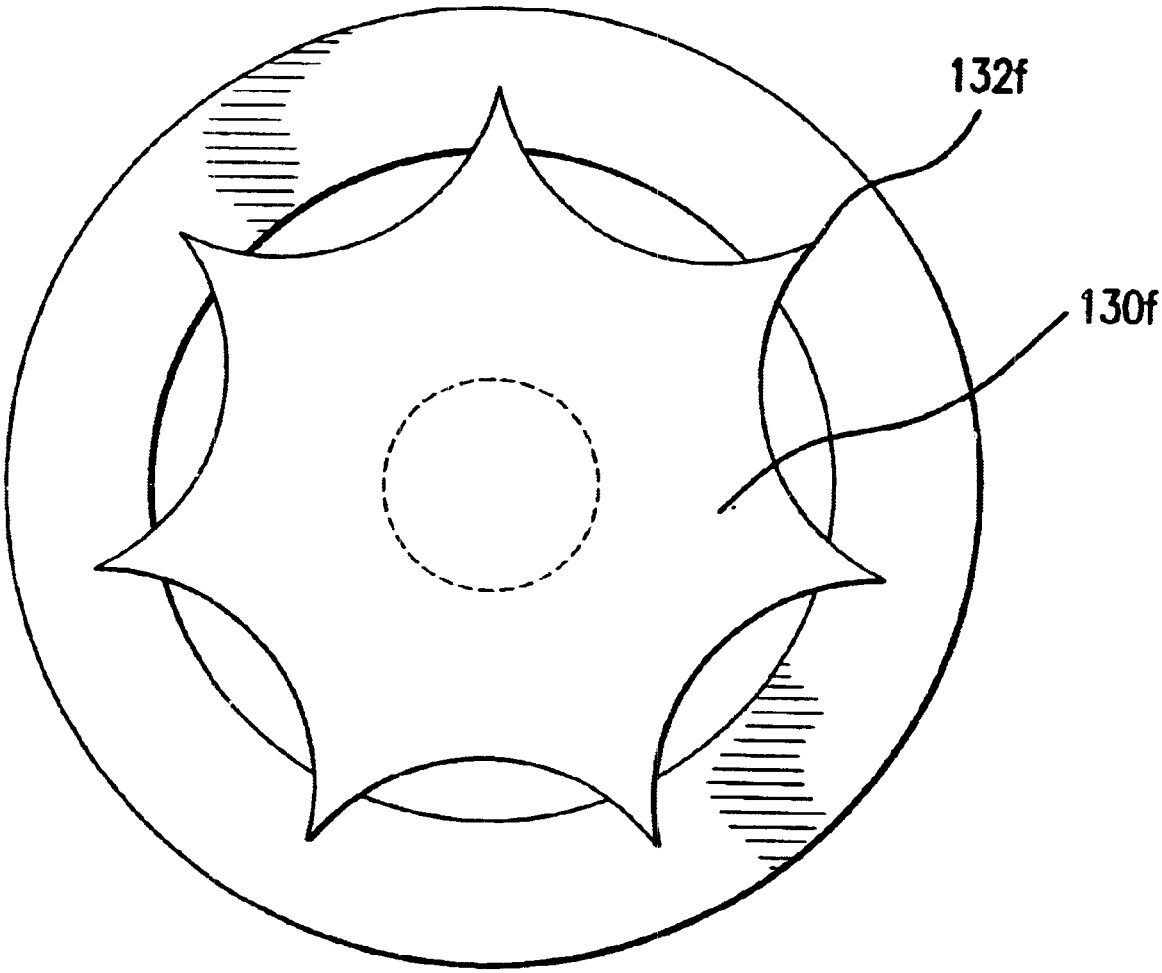
Figure 10:
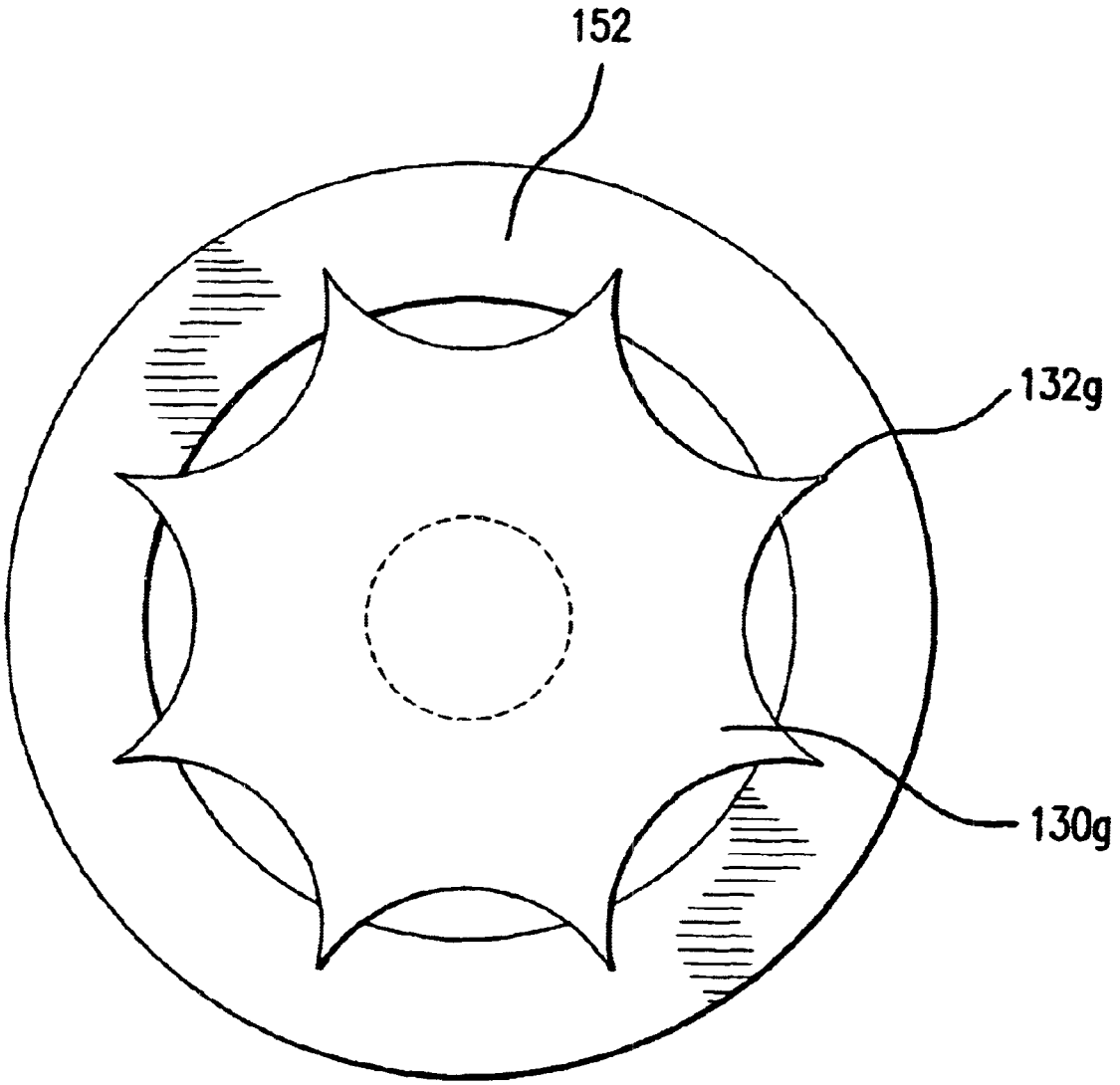
Figure 11:
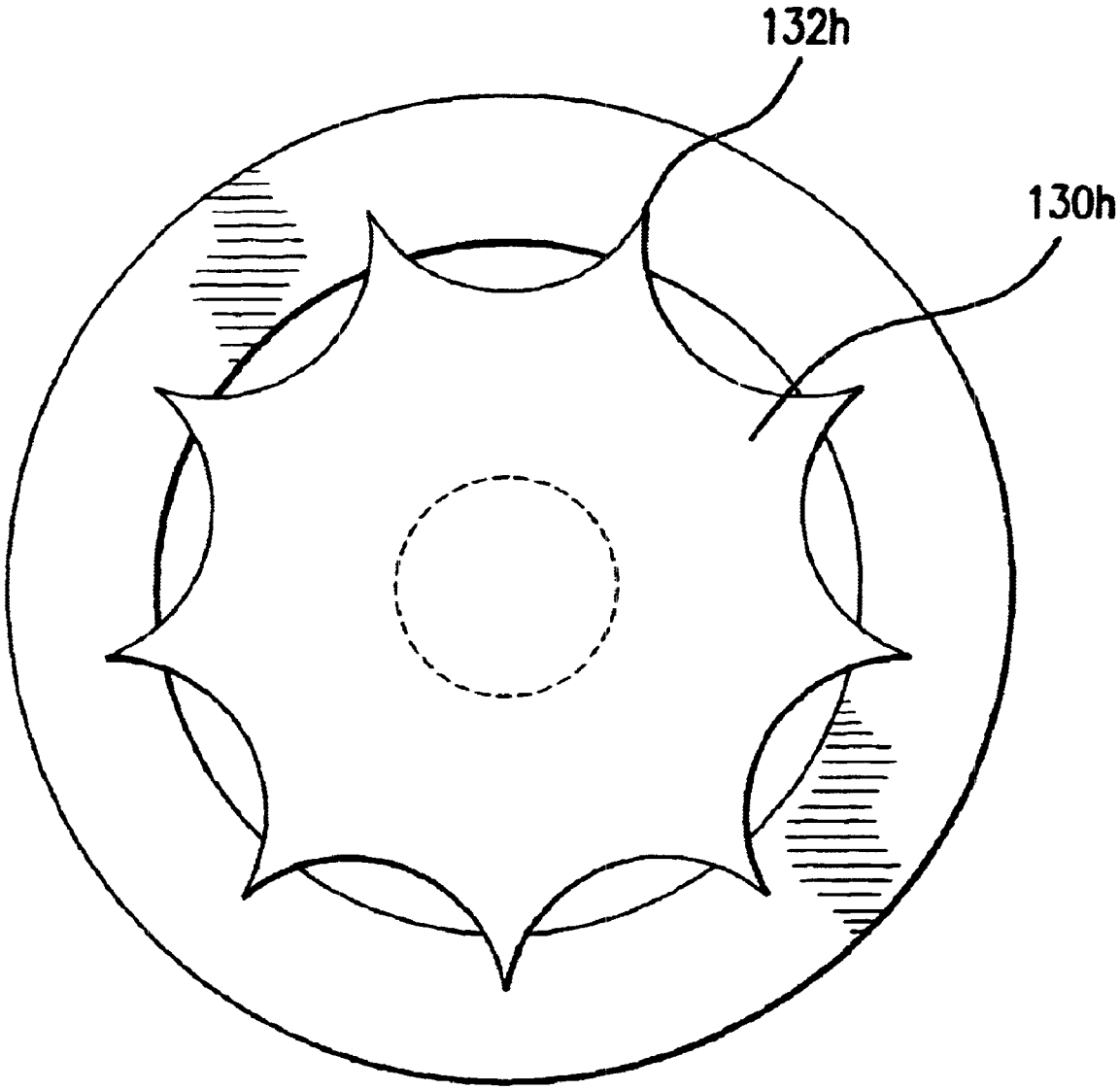
Figure 12:
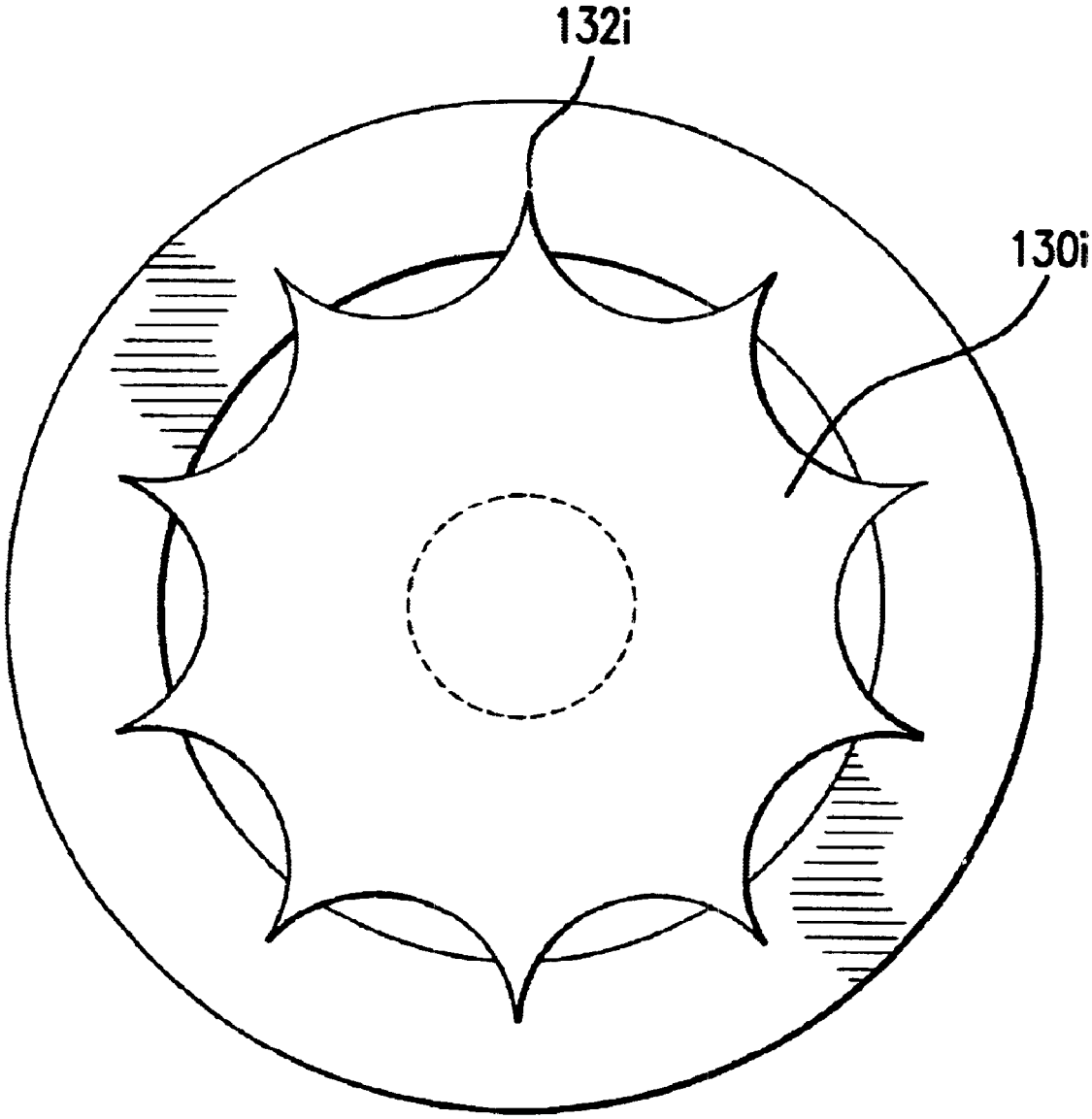
Figure 13:
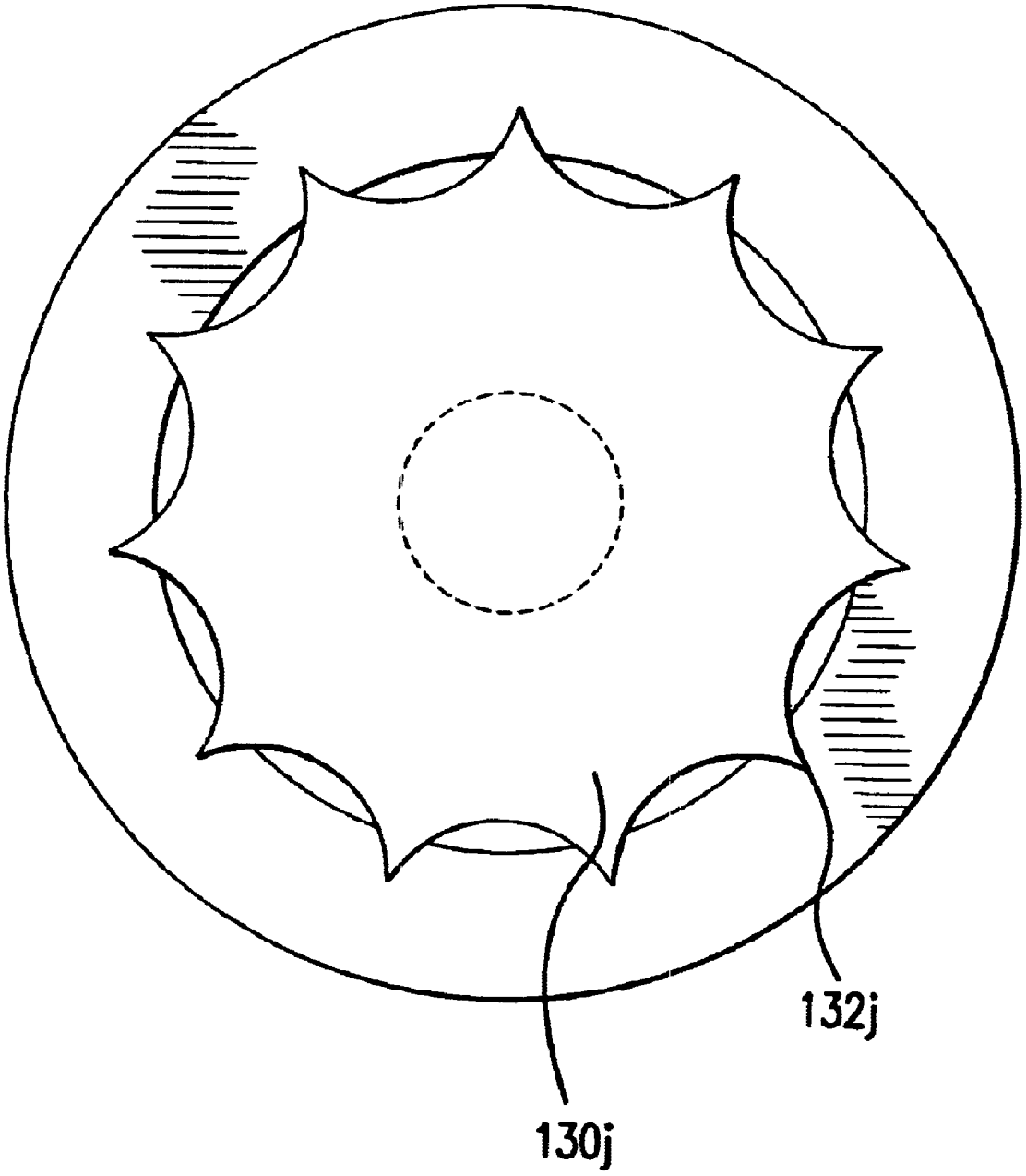
Figure 14:
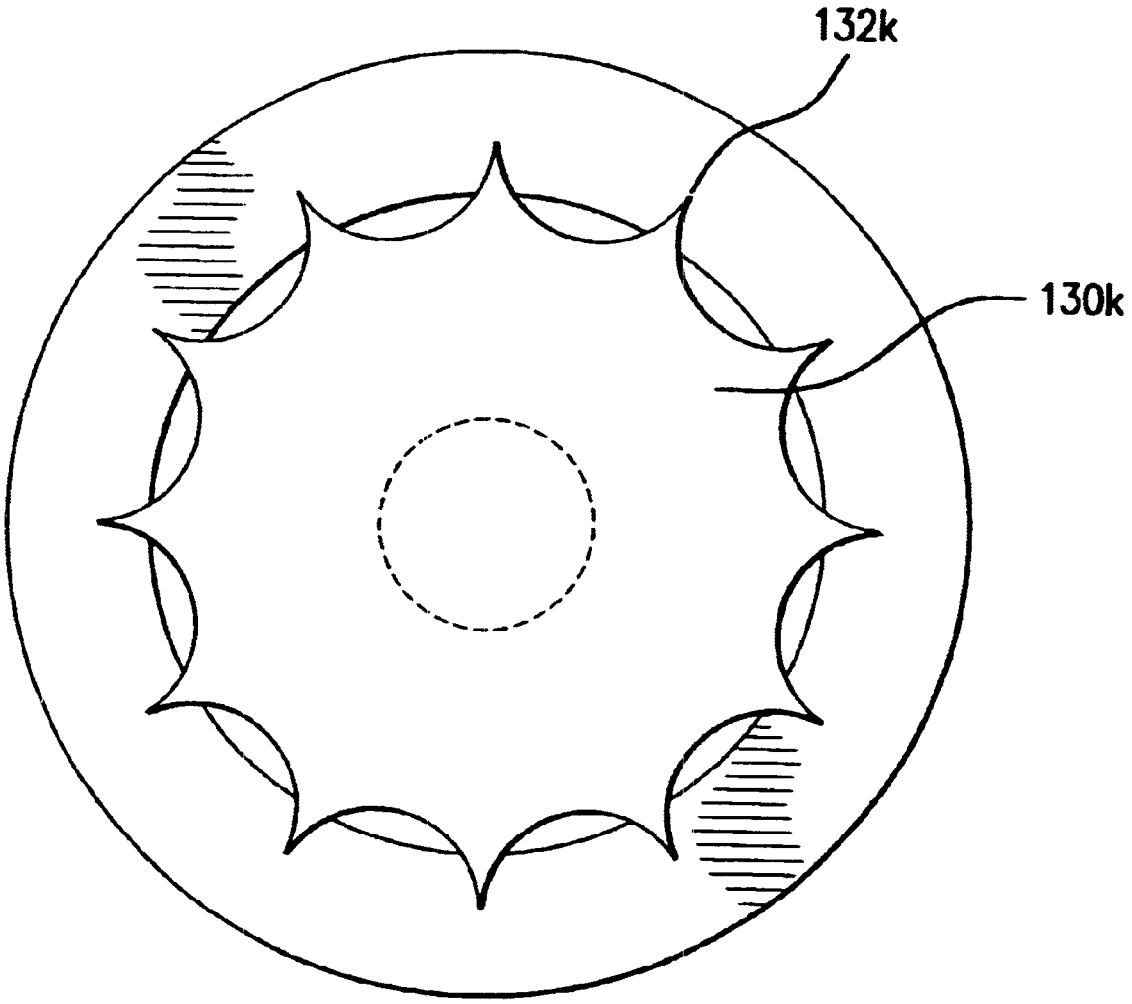

FIGS. 1–3 show generally a spark plug 10 comprising a shell 11, a central electrode 20, an insulator 14, a cap 30, a ground collar 40, and a firing ring 50. The central electrode 20 has a distal end 22 and a proximal end 24, wherein, after the spark plug 10 has been mounted onto the cylinder head of an engine, the proximal end 24 lies within the combustion chamber of the cylinder and the distal end 22 is disposed outside of the cylinder.

The electrode 20 is surrounded by the insulator 14. Typically, the insulator 14 is a ceramic jacket that is concentric with, and is disposed between, the central electrode 20 and the shell 11 of the spark plug 10. The insulator 14 acts to electrically isolate the central electrode 20 from the shell 11, as well as insulate the central electrode 20 by keeping excessive heat, to the extent practicable, from reaching the central electrode 20. In this regard, a feature of an embodiment of the present invention is that, given the structure and material composition of the invented spark plug as discussed more fully below, the central electrode 20 can be covered by the insulator 14 along substantially all of its length. This is shown most clearly in FIG. 3, where a proximal end 15 of the insulator 14 extends all the way to the center of the cap 30, such that the proximal end 15 and the proximal end 24, of the insulator 14 and the central electrode 20, respectively, are substantially coplanar. In other embodiments, the proximal end 15 of the insulator 14 may stop short of the proximal end 24 of the central electrode 20. See, e.g., FIG. 2.

The shell 11 of the spark plug 10 includes a threaded portion 12 along the upper half of the shell 11. In practice, the spark plug 10 is mounted into the cylinder head of an engine by mating the threaded portion 12 of the plug with a corresponding threaded portion (not shown) of the cylinder head. By convention, a spark plug 10 may be identified by the magnitude of the outer diameter of its threaded portion 12. For example, a "10 mm plug" refers to a spark plug 10 wherein the threaded portion 12 has an outer diameter of 10 mm. Although the principles of the instant invention may be applied to a broad range of sizes of spark plugs, the present description alternatively addresses at least four such sizes, i.e., 10 mm, 12 mm, 14 mm, and 16 mm, for illustrative purposes.

In a preferred embodiment of the invention, a ground collar 40 is attached, by welding or other similar means, to the threaded portion 12 of the spark plug 10. As shown in FIG. 2, the ground collar 40 has a proximal end surface 42. In this embodiment, a firing ring 50 is integrally attached to the proximal end surface 42 of the ground collar 40. Thus, in FIG. 1, for example, the ground collar-firing ring combination is shown as a single integrated structural element 40, with a firing surface 52.

In an alternative embodiment, the firing ring 50 may be attached directly to the threaded portion 12, without the addition of an intervening ground collar 40. Such an arrangement allows the spark plug to be used in smaller engines, where the longitudinal length of the spark plug is limited by the size of the cylinder containing the combustion chamber, as well as the piston head clearance.

In a preferred embodiment of the invention, a star-shaped cap 30 is provided on the proximal end 24 of the central electrode 20. The cap 30 has a generally concave configuration and has projections, or tips, 32, which protrude radially from the periphery of the cap 30. Because of the concavity of the cap 30, the tips 32 extend towards the firing surface 52 of the firing ring 50, resulting in an electrical gap G which, as shown in FIGS. 1 and 3, is defined in the space between the tips 32 and the firing surface 52.

In operation, an electric current is applied at the distal end 22 of the central electrode 20, which is then conducted to the tips 32 through the proximal end 24 and the cap 30. The current is applied such that, at the appropriate time within the compression cycle of the cylinder, the magnitude of the current causes an electrical charge to jump the gap G and simultaneously generate a spark between each tip 32 and the firing surface 52. As will be explained more thoroughly below, the simultaneous generation of the multiple sparks is a function not only of the physical shape and arrangement of the cap 30 and firing ring 50, but also the material composition of the cap 30, the ring 50, and the central electrode 20.

FIGS. 4 to 39 depict variations of the number and geometrical configuration of the tips 32 for the cap 30. More specifically, FIGS. 4–15 show a first embodiment, wherein the tips 132*a*–132*k* of the caps 130*a*–130*k* FIGS. 16–27 show a second embodiment, wherein the tips 232*a*–232*k* of the caps 230*a*–230*k*, respectively, are squared, or flattened, so that a set of edges 232*a*', 232*a*"–232*k*', 232*k*" is formed on each of the tips 232*a*–232*k*, respectively. Finally, FIGS. 28–39 show an alternative embodiment, wherein the tips 332*a*–332*k* of the caps 330*a*–330*k*, respectively, are forked, such that a set of points 332*a*', 332*a*"–332*k*', 332*k*" is formed on each of the tips 332*a*–332*k*, respectively.

As can be seen from FIGS. 4–39, for each of the three embodiments discussed immediately above, the cap 130, 230, 330 may have between two (2) and twelve (12) tips 132, 232, 332. In practice, the choice as to the number of tips will depend on the type of engine in which the spark plug 10 of the instant invention is to be used. As has been discussed previously, the spark plug of the instant invention enables the plug to produce simultaneous sparks from every tip on a given cap. Therefore, the larger the number of the tips, the larger the number of simultaneous sparks, and the greater the speed and efficiency of burn within the combustion chamber.

Since a faster and more efficient combustion is a desirable attribute, then, in general, it may be assumed that caps with a maximum number of tips should be used. However, the use of a larger number of tips (and, therefore, sparks) also results in a higher combustion-chamber temperature, which may not be desirable for a given application. As such, in each application, the specific number of tips on the spark-plug cap is preferably tailored to the desirable temperature range for that application.

Considering the operation of the embodiment of FIGS. 4–15, a single spark will be generated between each of the tips 132*a*–132*k*, on the one hand, and the firing surface 152, on the other. Thus, for example, in the 8-pointed star cap 130*g* of FIG. 10, eight simultaneous sparks will be generated between the tips 132*g* and the firing surface 152 each time the spark plug fires.

In contrast, the embodiments of FIGS. 16–27 and 28–39 offer configurations wherein two (2) sparks are generated at each tip of the cap each time the spark plug fires. Thus, for example, in FIG. 22, when the spark plug is activated, a spark is generated at each edge 232*g*', 232*g*" of every tip 232*g*, such that, in sum, a total of 16 sparks are simultaneously generated. Similarly, in FIG. 34, a spark is generated from each point 332*g*', 332*g*", thus producing 16 simultaneous sparks.

Caps having square tips 232*a*–232*k*, and those having forked tips 332*a*–332*k*, are used in different applications. In both embodiments, when the spark plug 10 is activated, the sparks that are generated occur between each tip and the firing surface. However, in the embodiment of FIGS. 28–39, the sparks additionally occur between the two points on each tip, which causes an increase in the combustion temperature. As such, caps with forked tips may generally be better suited for high-performance applications.

In a preferred embodiment, the central electrode 20, the cap 30, the ground collar 40, and the firing ring 50 are all preferably made of the same composition of material forming an alloy. In a preferred embodiment, the alloy comprises:

| Element | % By Weight |
|---|---|
| Aluminum | 0.18–0.21 |
| Boron | 0.001–0.004 |
| Titanium | 0.210–0.220 |
| Molybdenum | 1.0–1.25 |
| Manganese | 1.30–1.50 |
| Silicon | 0.60–0.75 |
| Carbon | 0.05–0.08 |
| Nickel | 25.0–26.0 |
| Vanadium | 0.20–0.30 |
| Iron | Remainder |

In a preferred embodiment, an alloy having the above composition is made in the form of a slab. It is of utmost importance to note that, in order for the alloy to have the advantageous properties that are necessary for, and are offered by, the present invention (e.g., resistivity, conductivity, heat resistance, thermal tolerances, etc.), the slab must be tempered instantly. The tempering process may be carried out in either one step or, alternatively, in several sequential steps. However, regardless of which scheme is used, care must be taken to ensure that the tempered material has a Brinell Hardness Number (BHN) lying within the range 190–225 so as to avoid the formation of an overly-brittle alloy.

Once a tempered slab of the above-described alloy has been produced, the slab is then shaped as necessary to make the various components of the spark plug. The central electrode, the ground collar, and the firing ring can be manufactured by conventional processes known to the person skilled in the art. With reference to FIGS. 1, 15, 27, and 39 by way of example, an illustrative process for shaping the cap may be described as follows.

Figure 15:
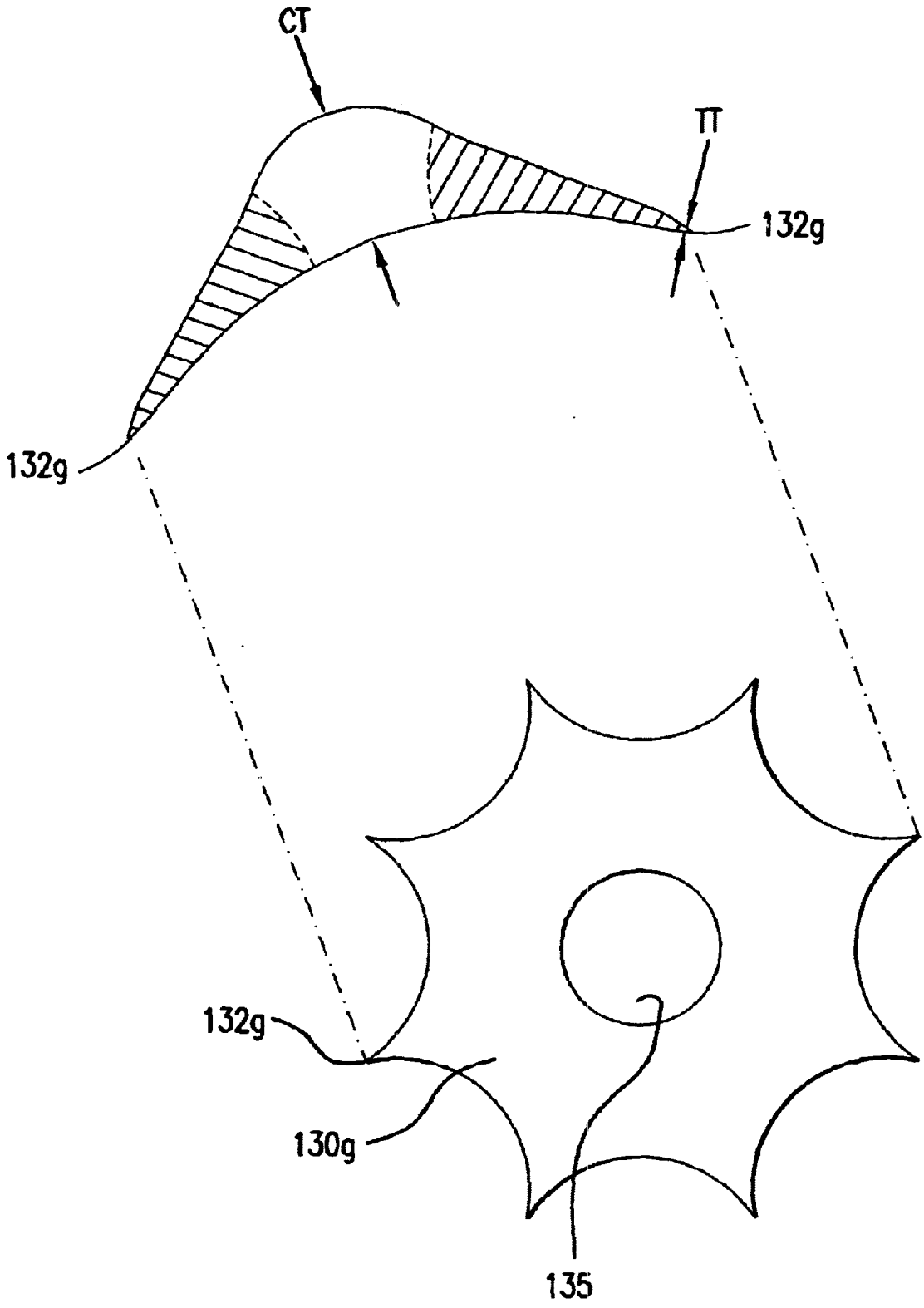
FIG. 15 is a cross-sectional view of the cap of the embodiment of FIG. 10 along the longitudinal axis of the spark plug.
Figure 16:
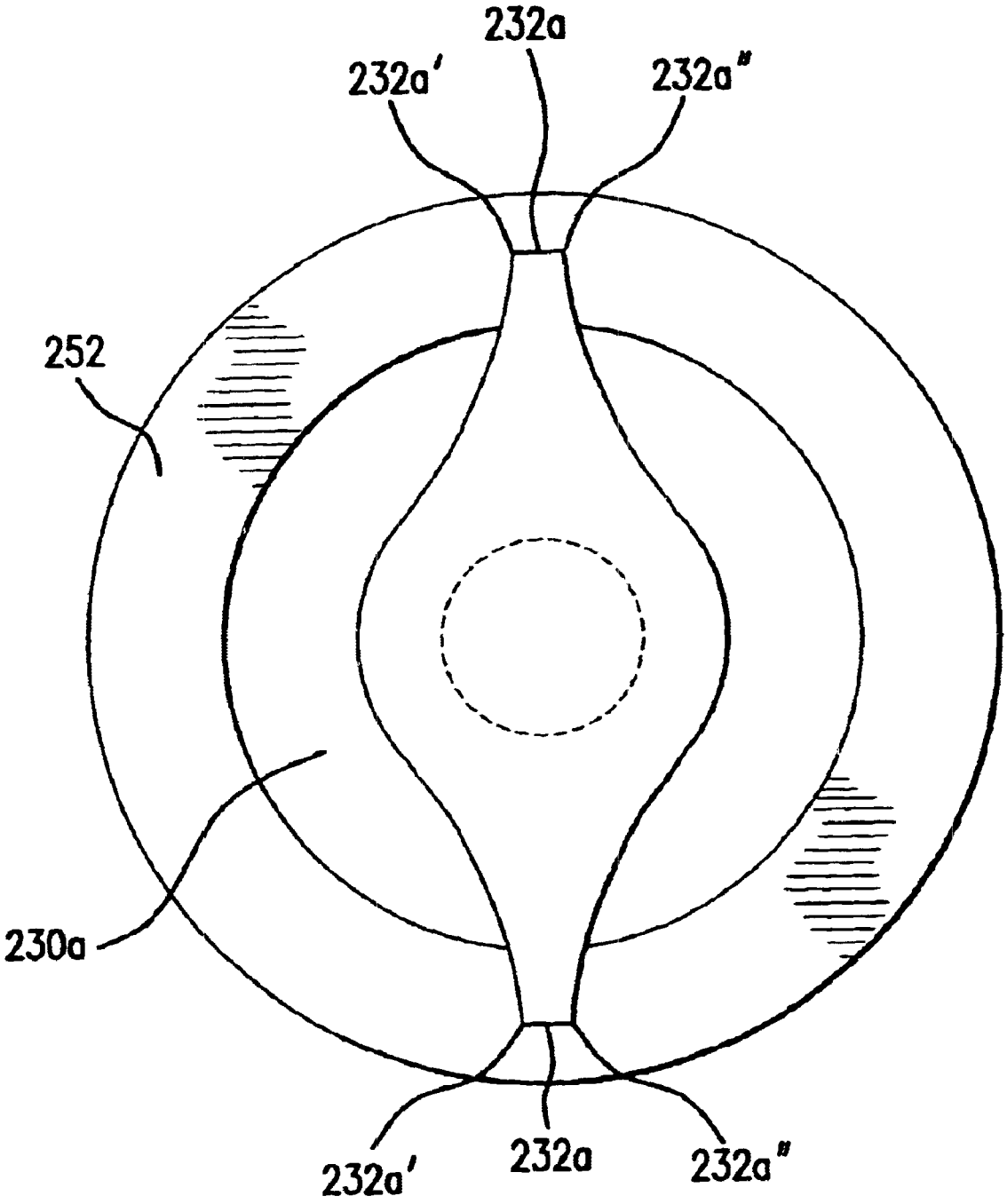
FIG. 16 is an enlarged top view of an embodiment of the invention.
Figure 17:
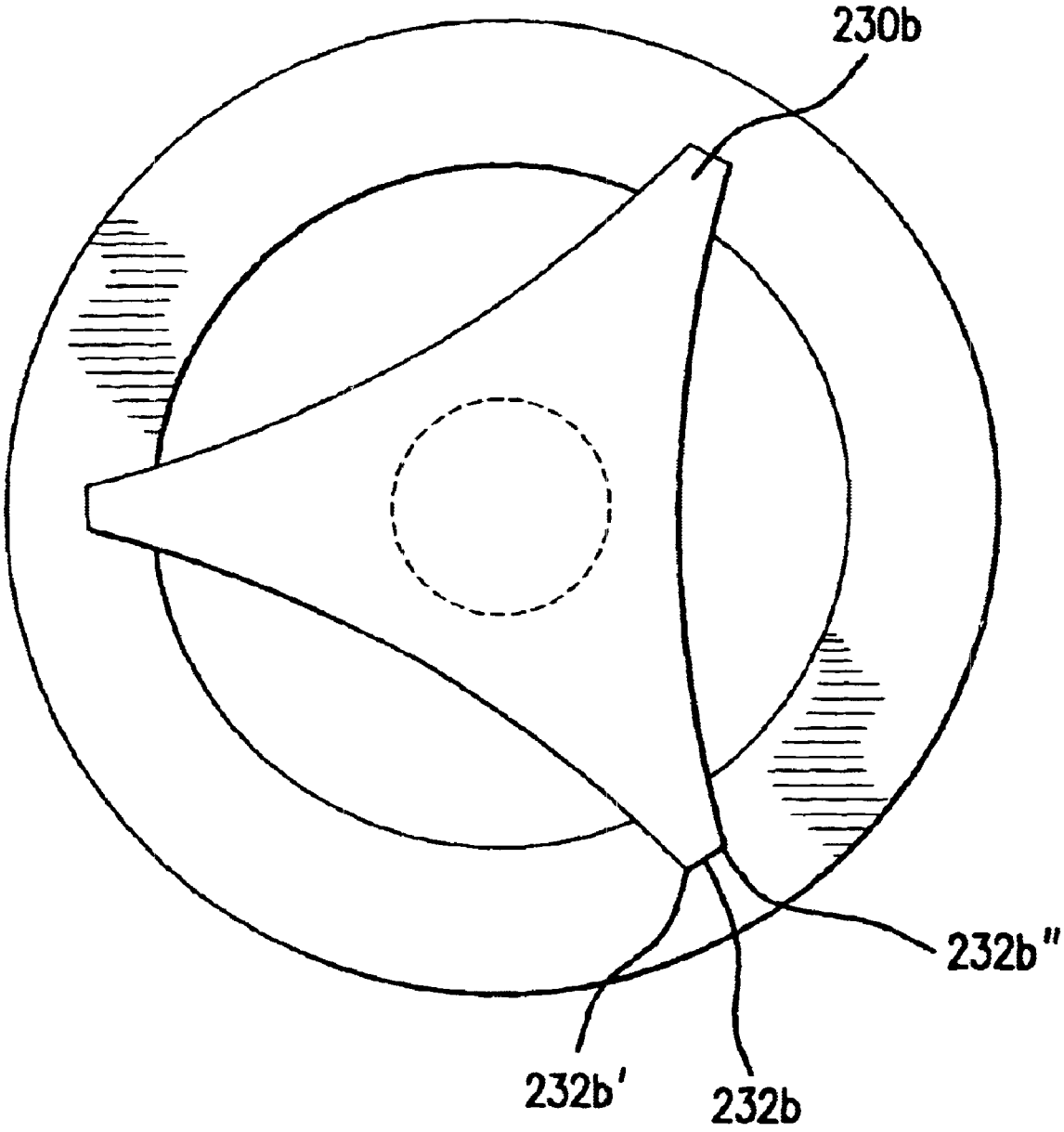
FIGS. 17–26 show variations of the embodiment of the invention shown in FIG. 16, wherein the cap has, respectively, between three and twelve tips.
Figure 18:
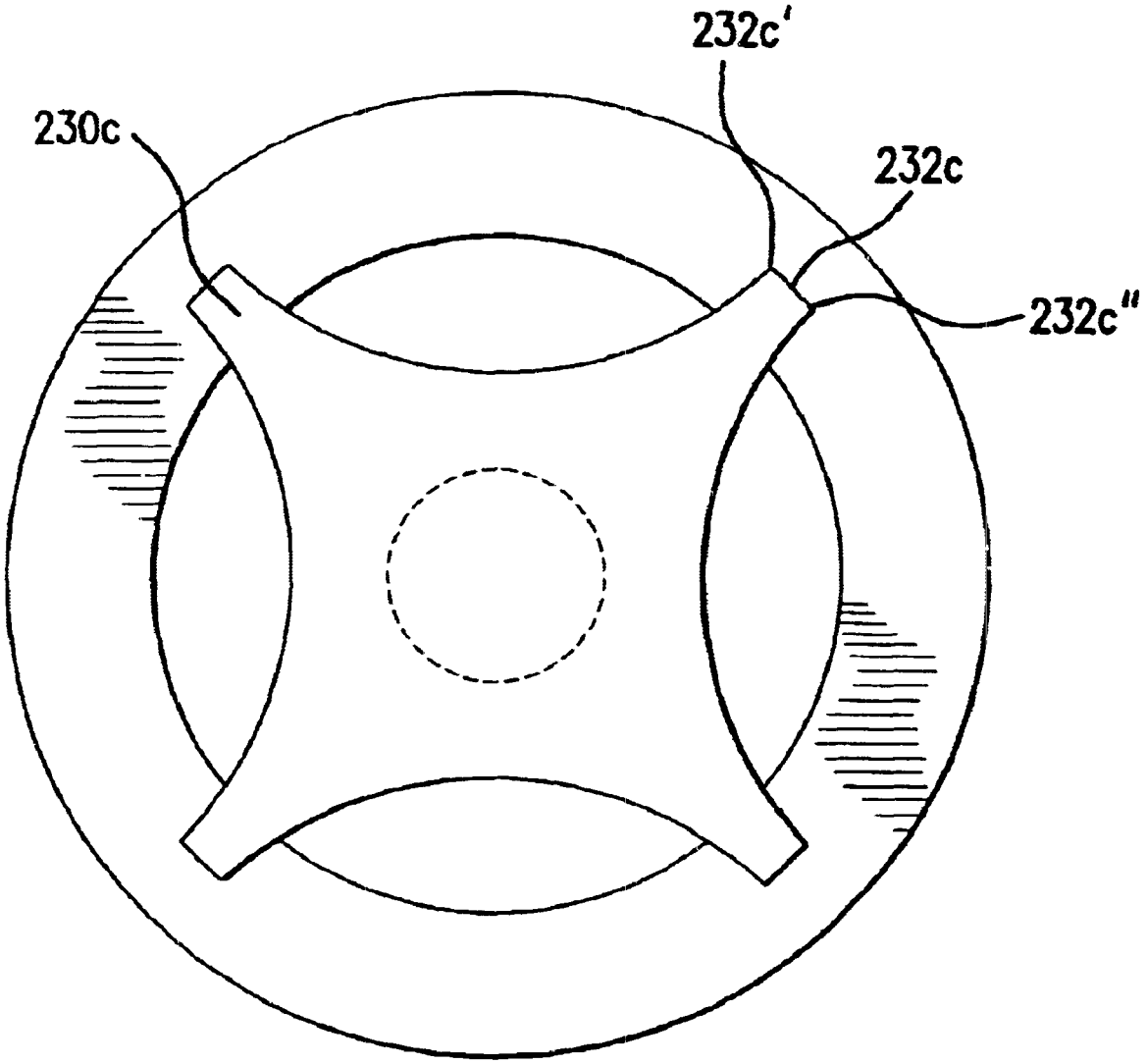
Figure 19:
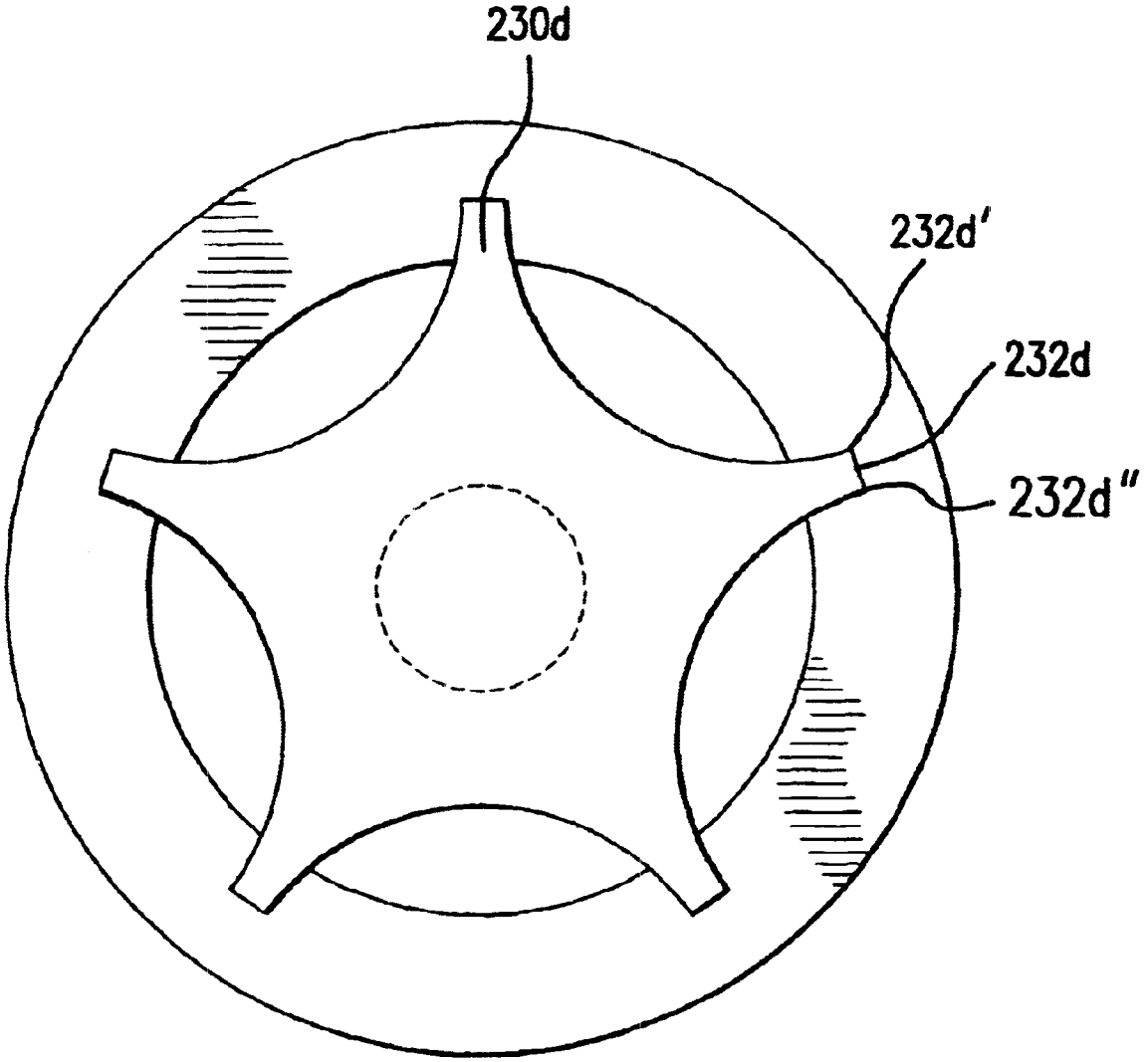
Figure 20:
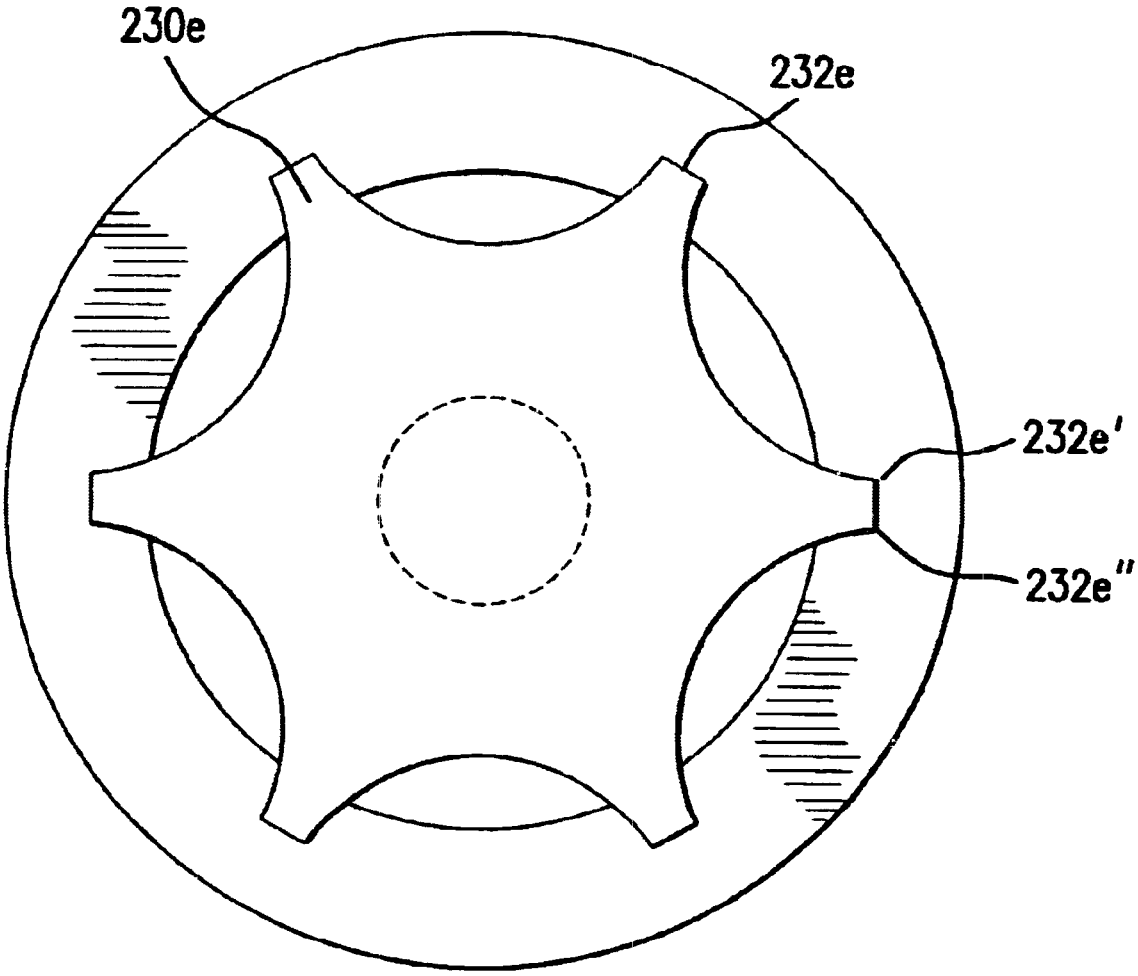
Figure 21:
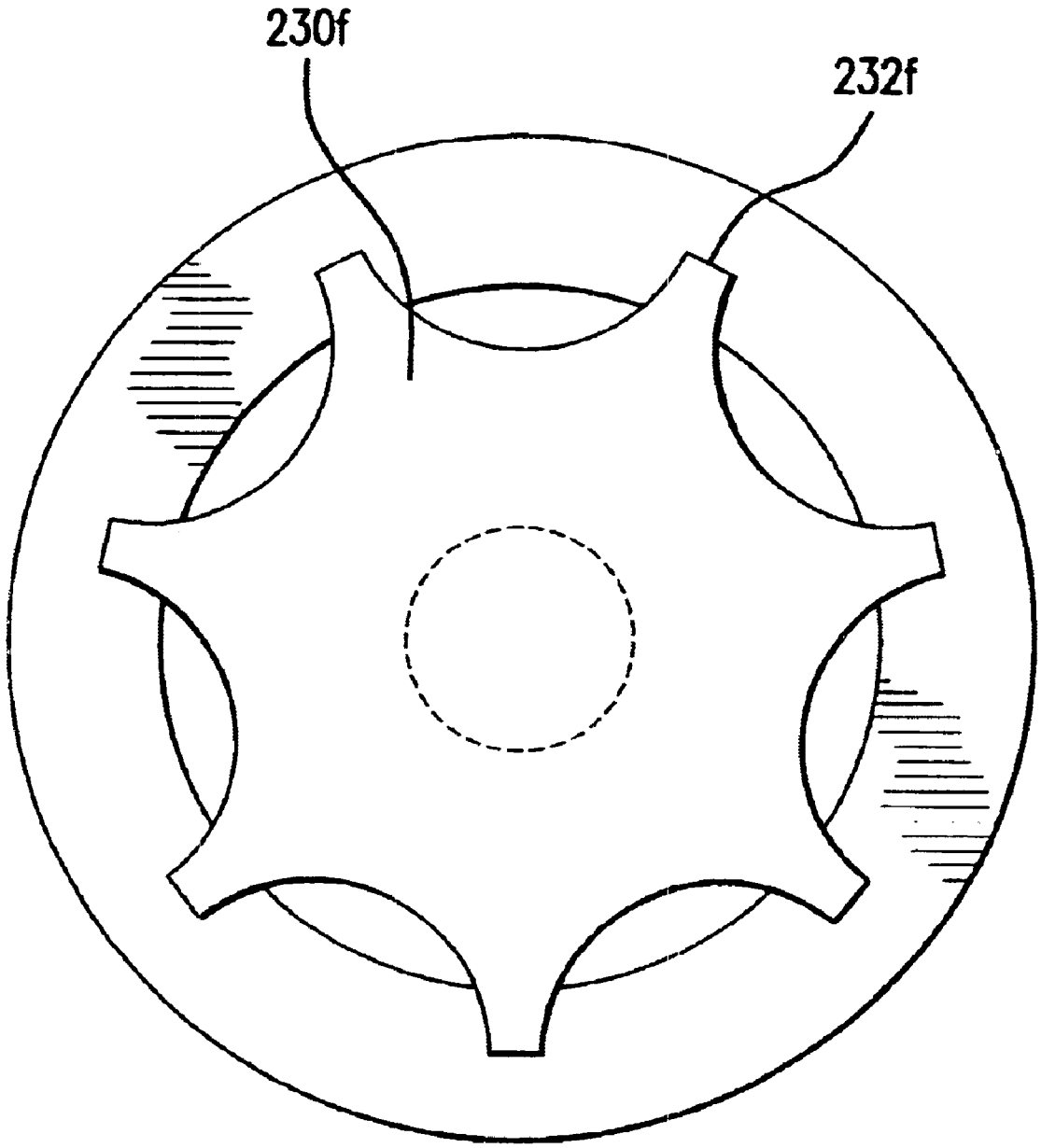
Figure 22:
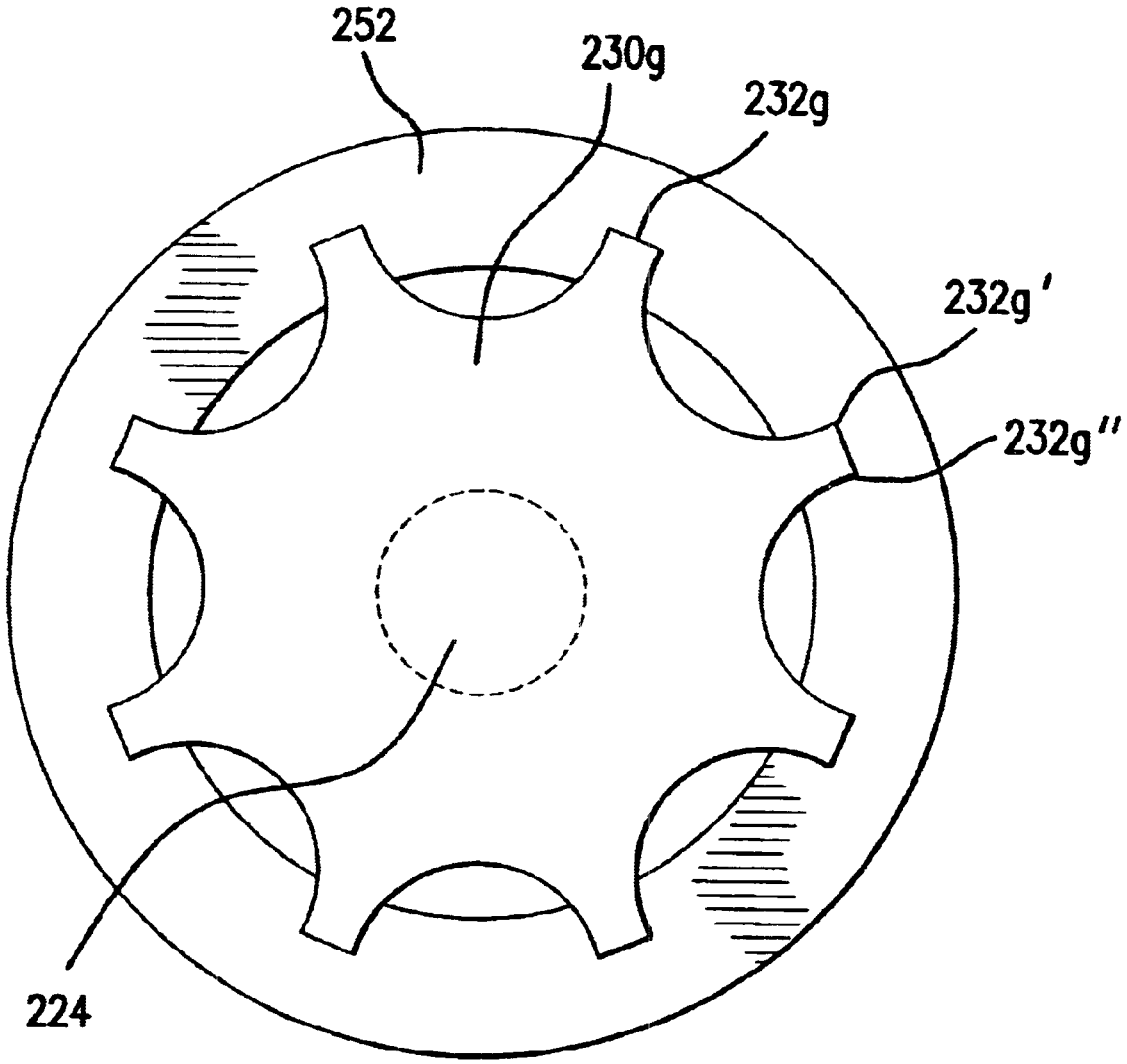
Figure 23:
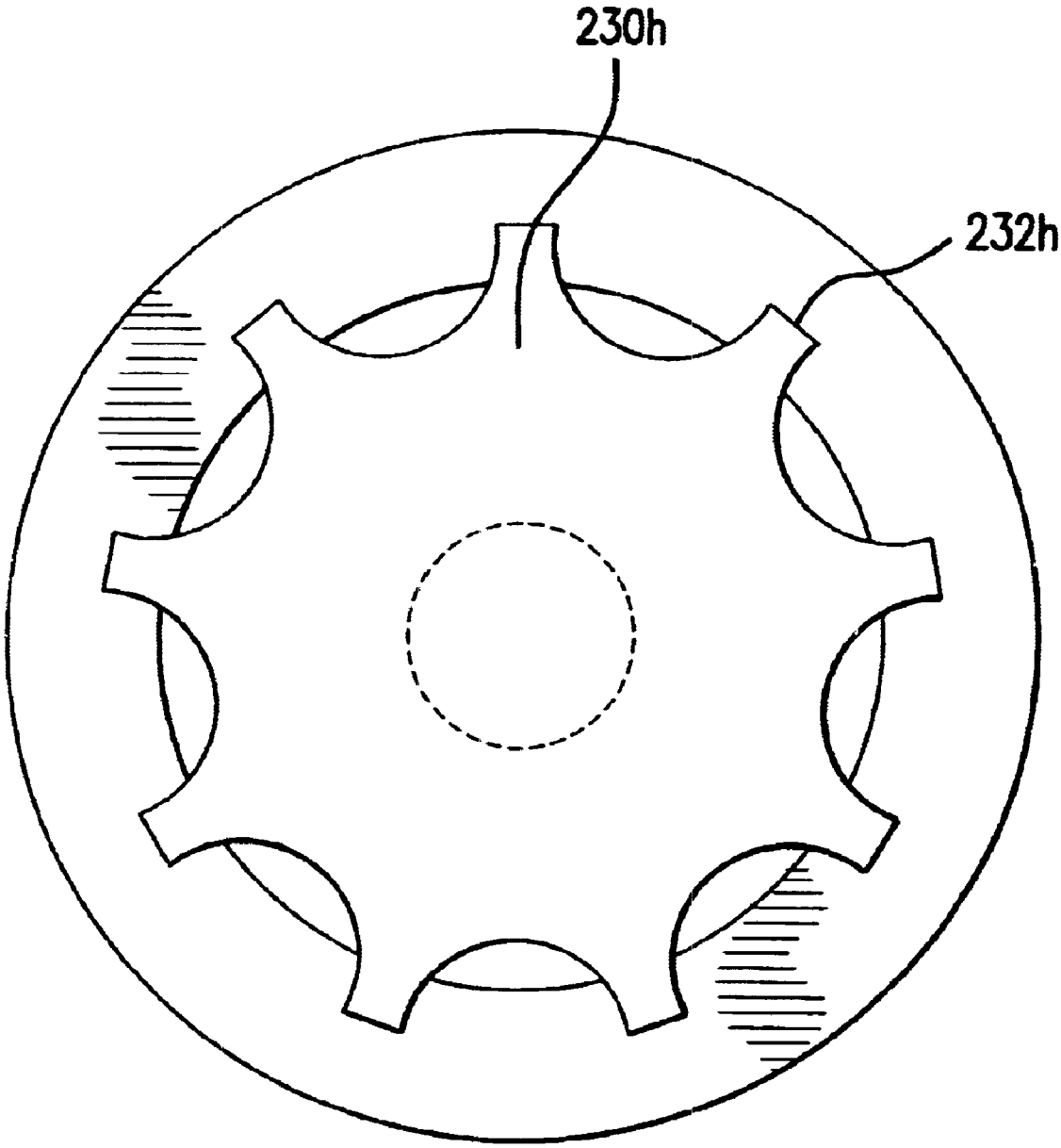
Figure 24:
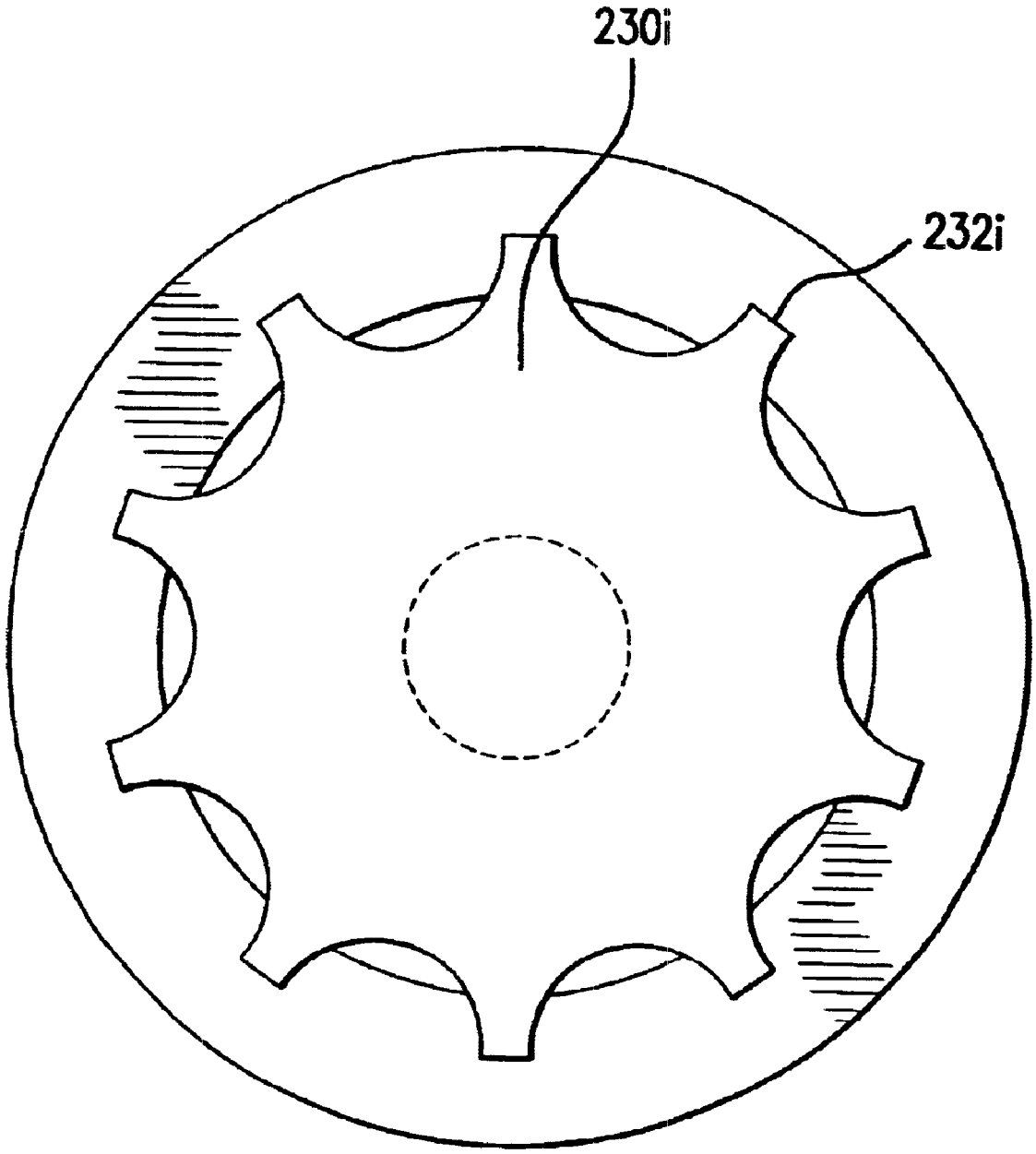
Figure 25:
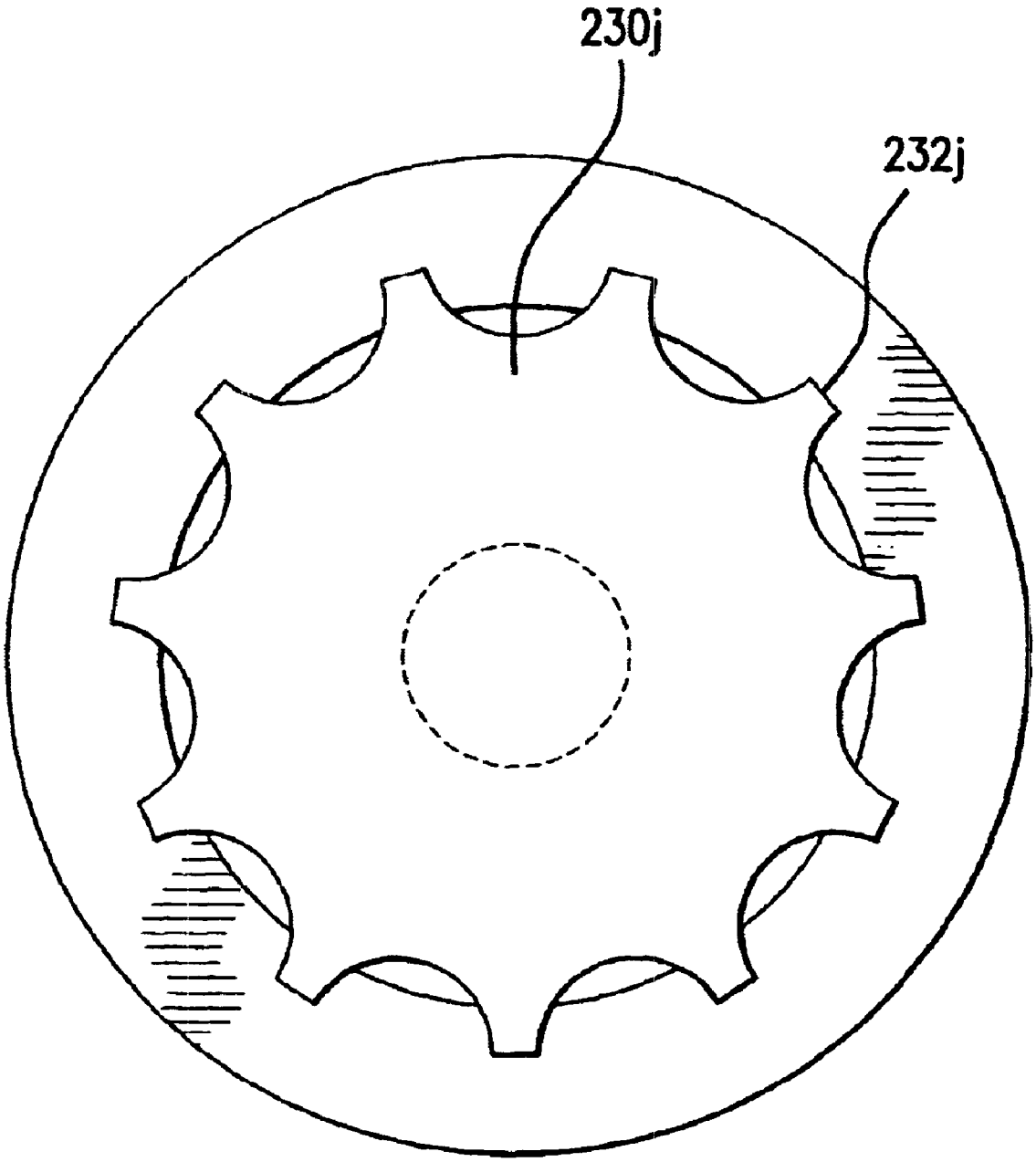
Figure 26:
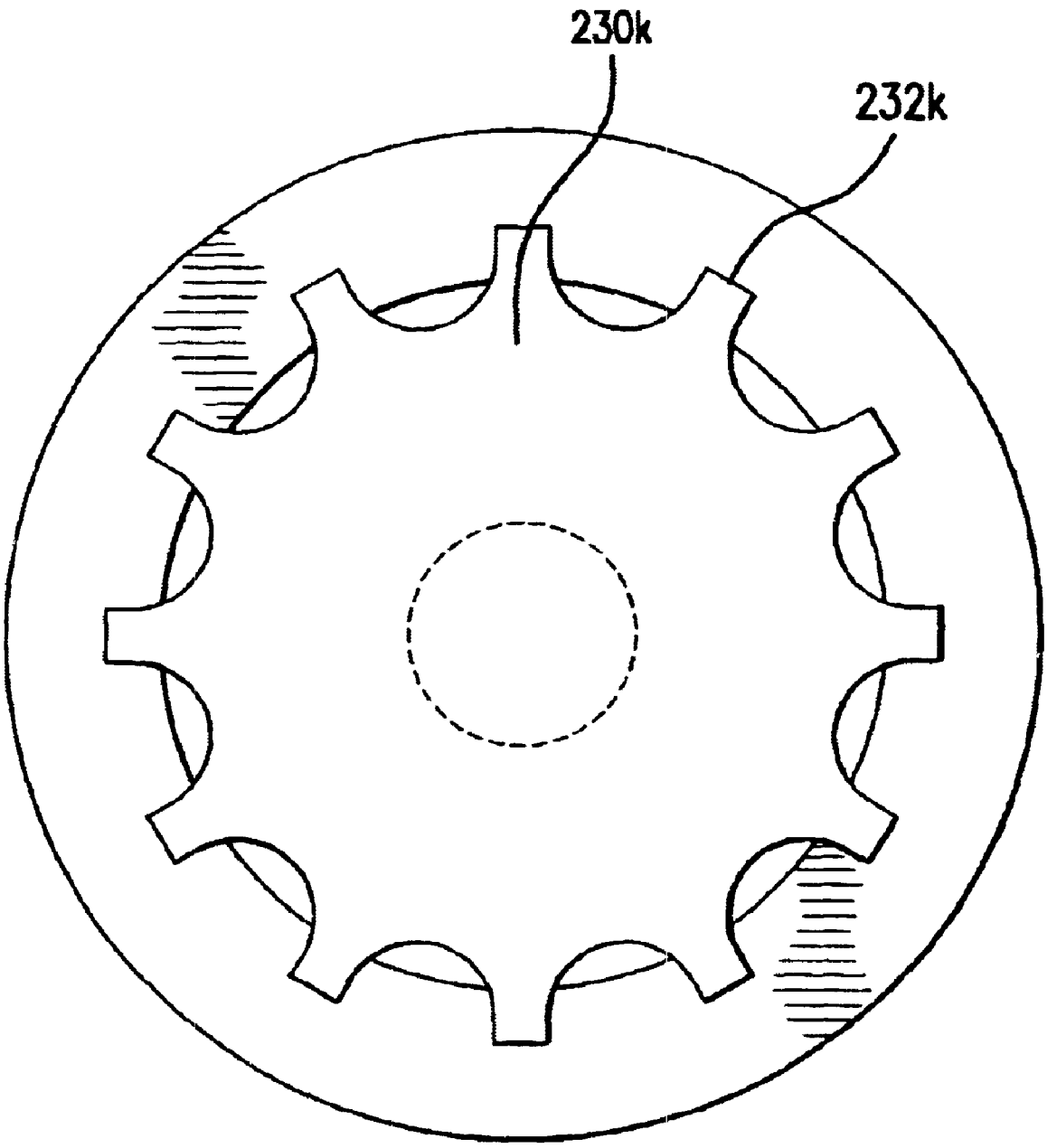

In order to manufacture the cap 130*g* of FIG. 15 for a 14 mm spark plug, for example, one may start with the tempered slab of the alloy just described, having a thickness of about 0.52 in. The slab is then punched, stamped, or otherwise cut using conventional methods, to produce a flat, 8-pointed, star-shaped cap such as is shown in the figure. At the same time, the center of the cap is punched, so that an opening having a diameter of about 0.10 in. is produced (see, e.g., aperture 135 in FIG. 15). Within the same process, the star-shaped cap is drill pressed to bend the material around a spherical, ball-shaped die having an outer diameter of about 0.375 in. It follows that the concave cap thus shaped will have an inner radius of curvature of about 0.1875 in. Finally, the center of the cap, whose central aperture has now been flared out due to the bending action around the ball, is built up, and the aperture closed off, using the same alloy from which the cap itself is initially manufactured.

As will be discussed below, the outer diameter of the cap must be such that it overlaps the firing surface of the firing ring by ⅓ to ½, i.e., such that the tips fall within the inner ⅓ to ½ of the wall thickness of the firing ring. As such, the diameter of the ball-shaped die, which also determines the radius of curvature of the cap, will change depending upon the size of the spark plug 10 (e.g., 10 mm or 16 mm plug) being used.

Figure 27:
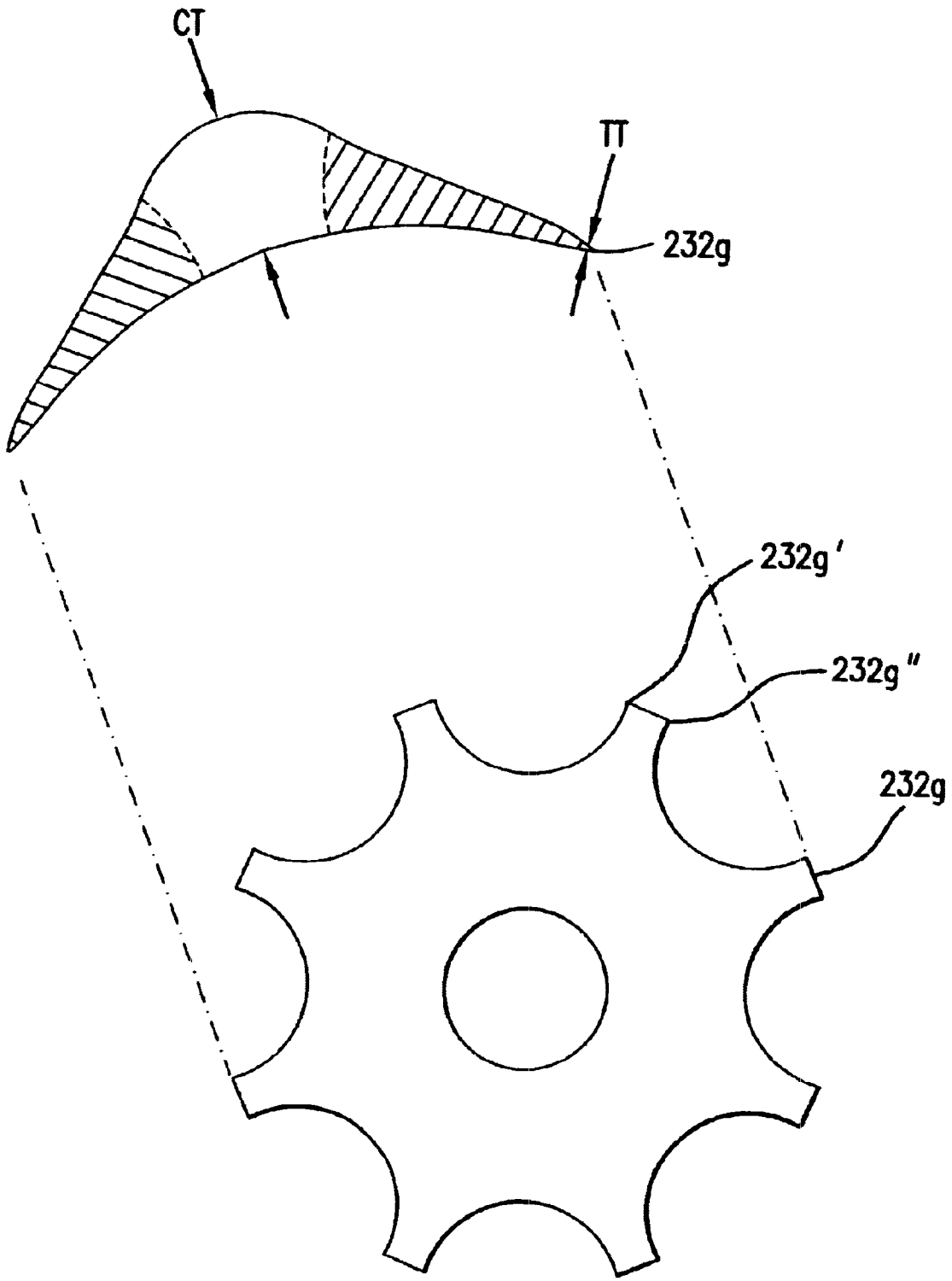
FIG. 27 is a cross-sectional view of the cap of the embodiment of FIG. 22 along the longitudinal axis of the spark plug.
Figure 28:
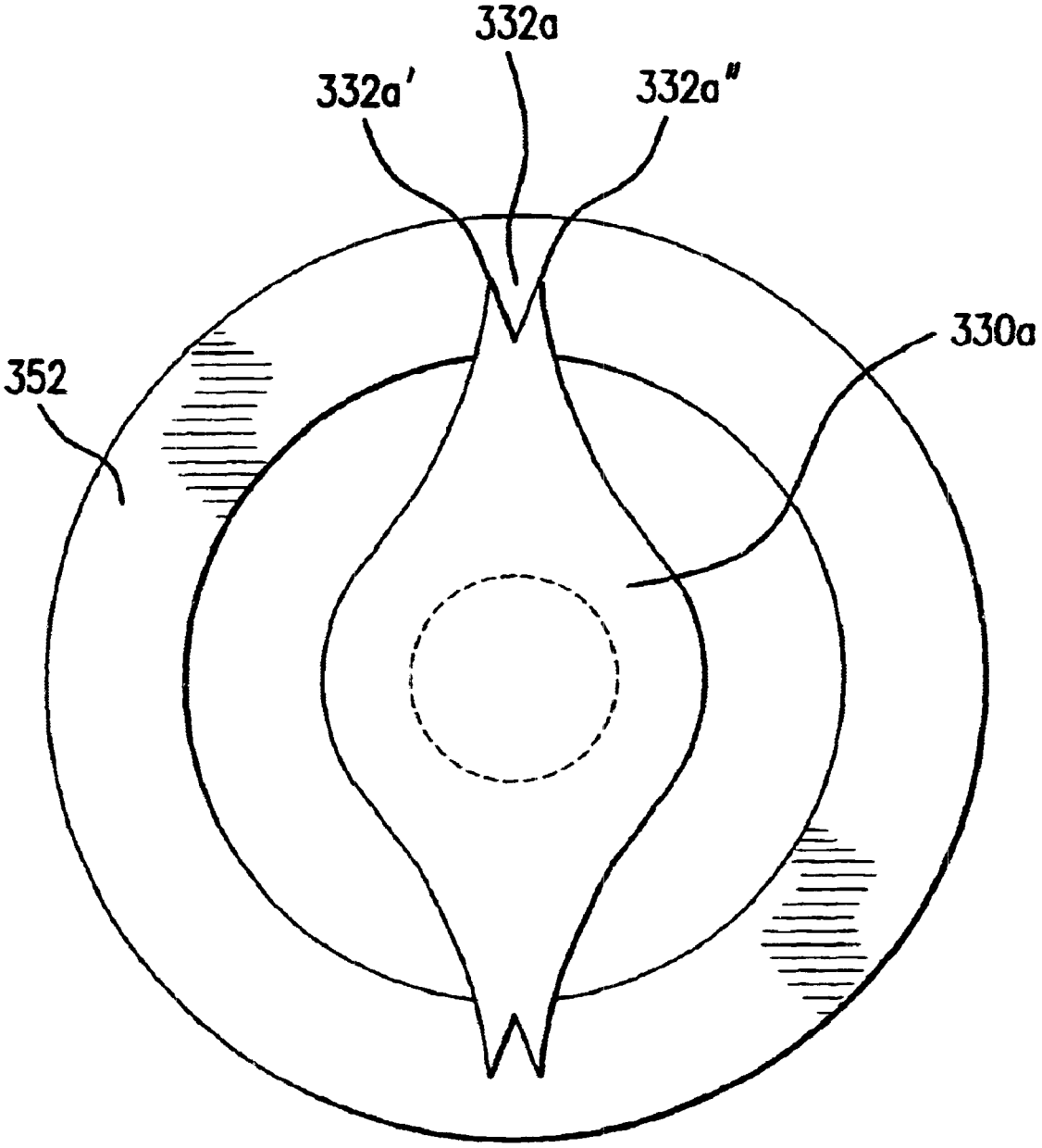
FIG. 28 is an enlarged top view of an embodiment of the invention.
Figure 29:
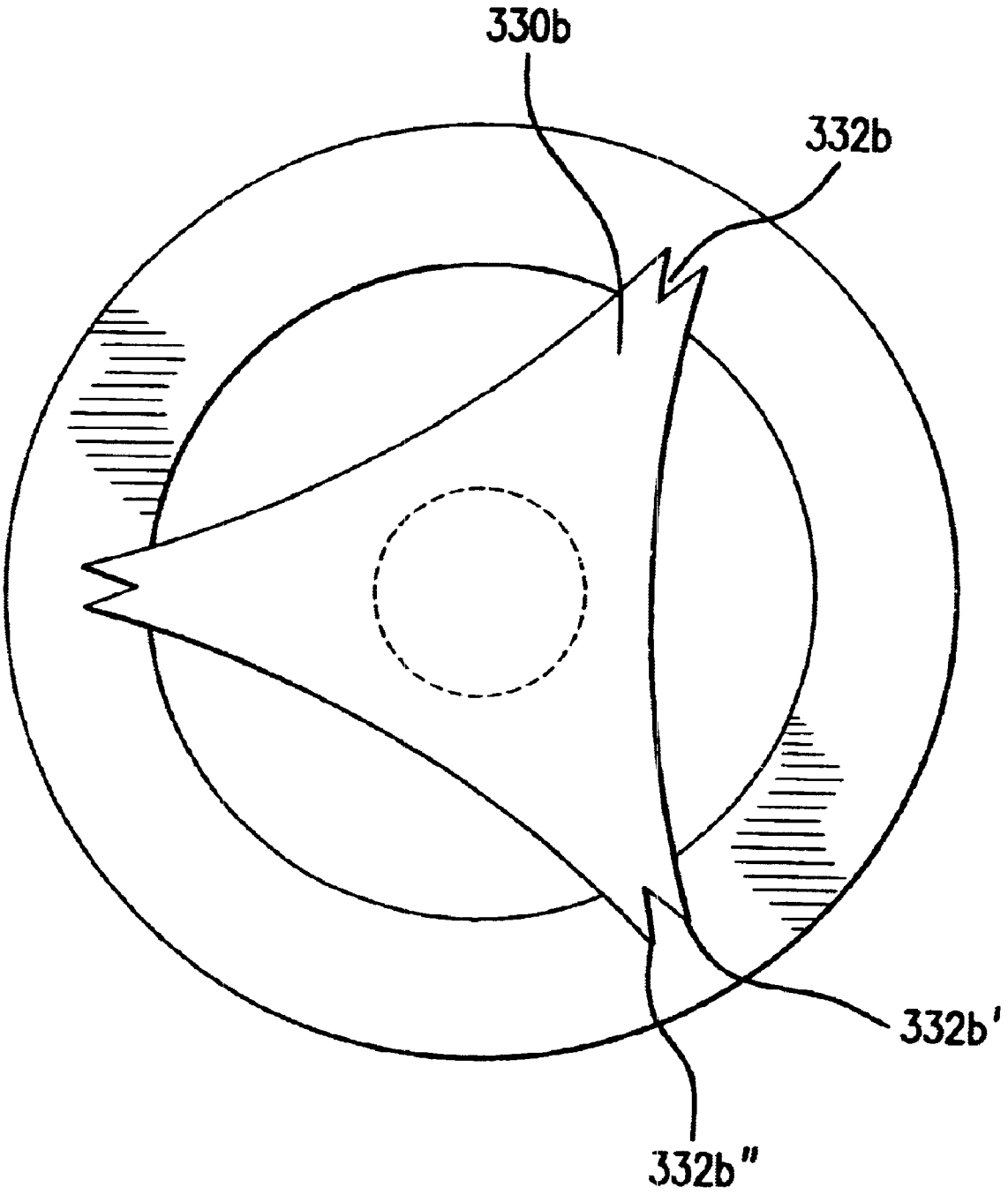
FIGS. 29–38 show variations of the embodiment of the invention shown in FIG. 28, wherein the cap has, respectively, between three and twelve tips.
Figure 30:
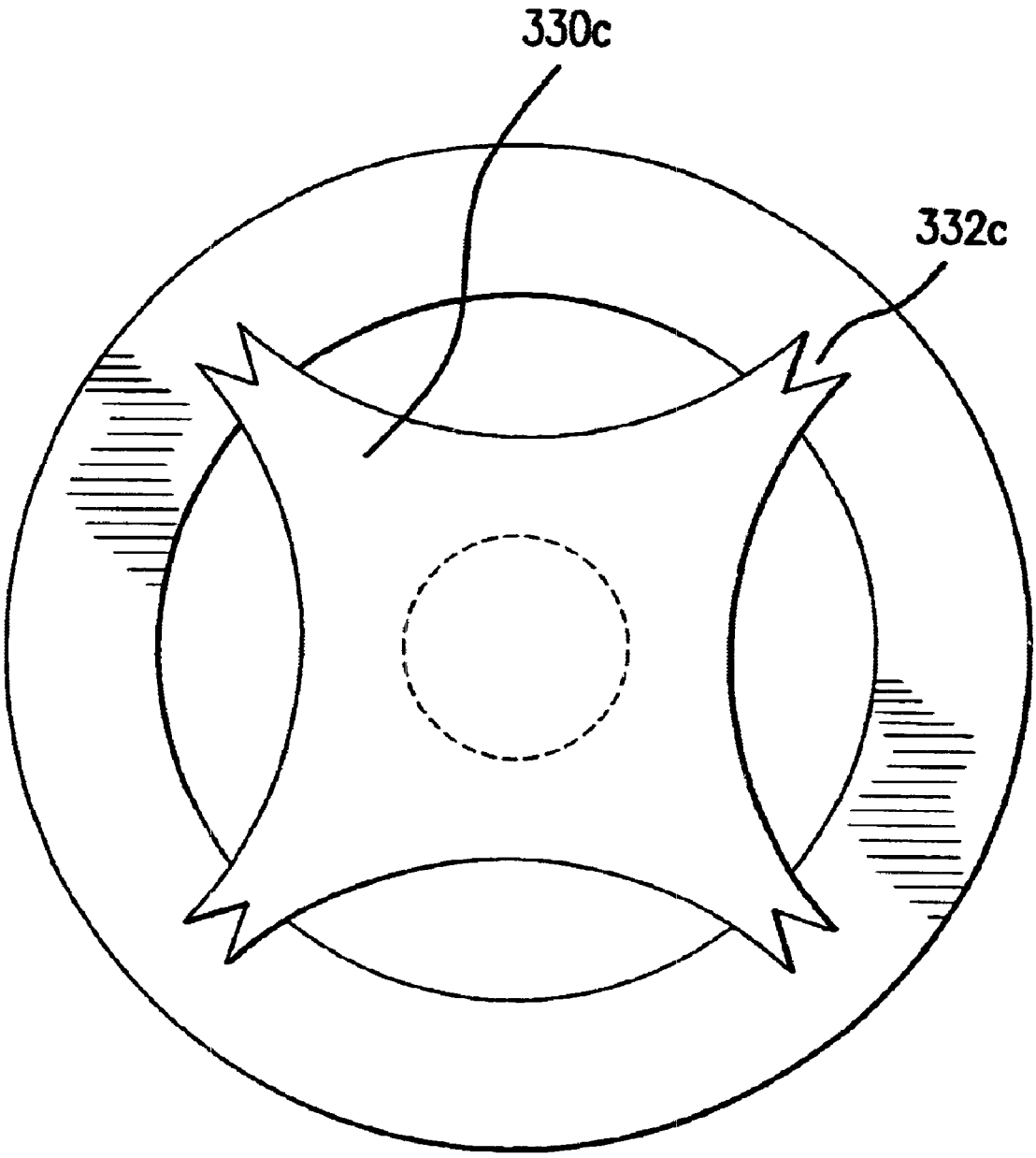
Figure 31:
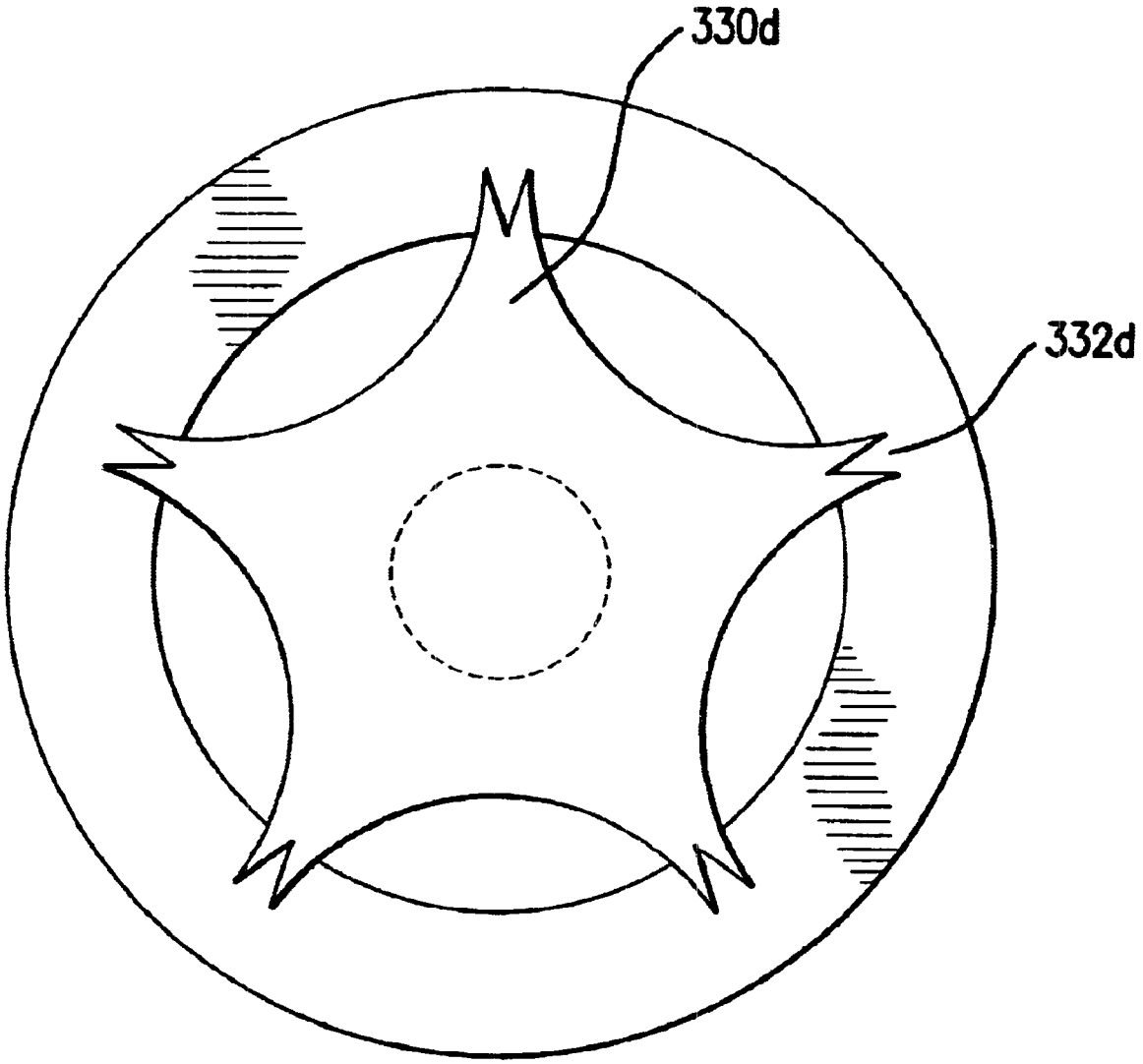
Figure 32:
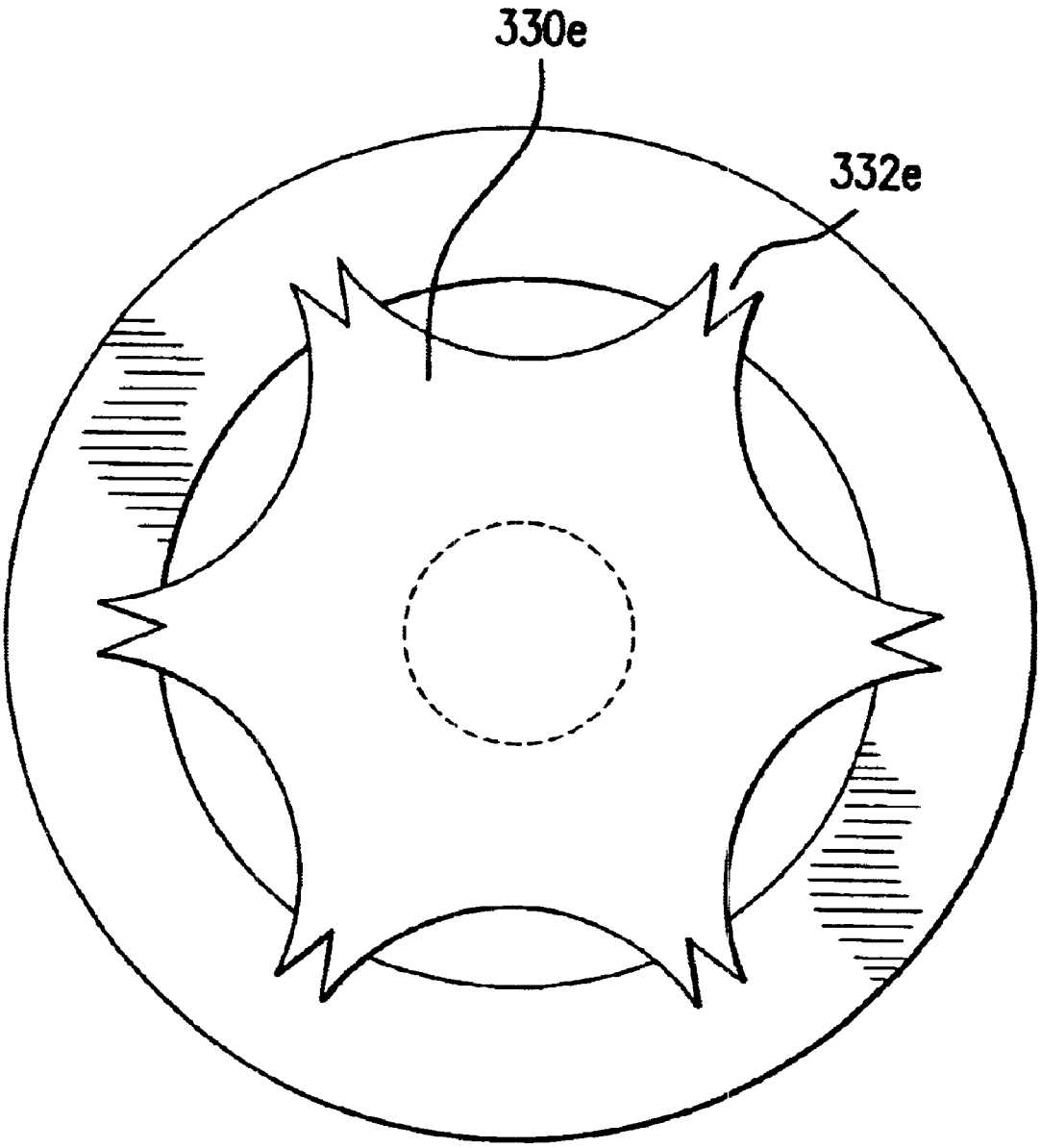
Figure 33:
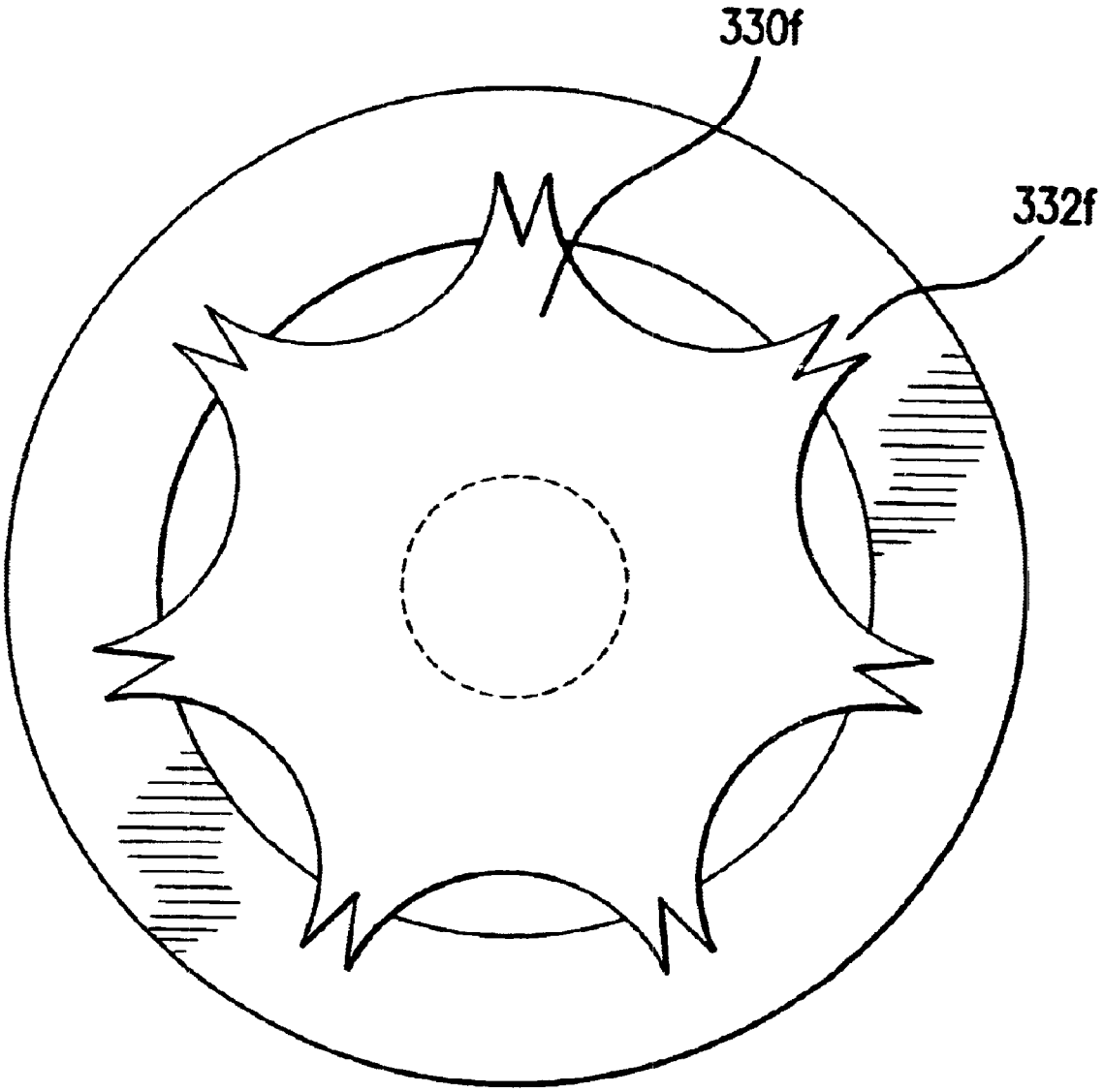
Figure 34:
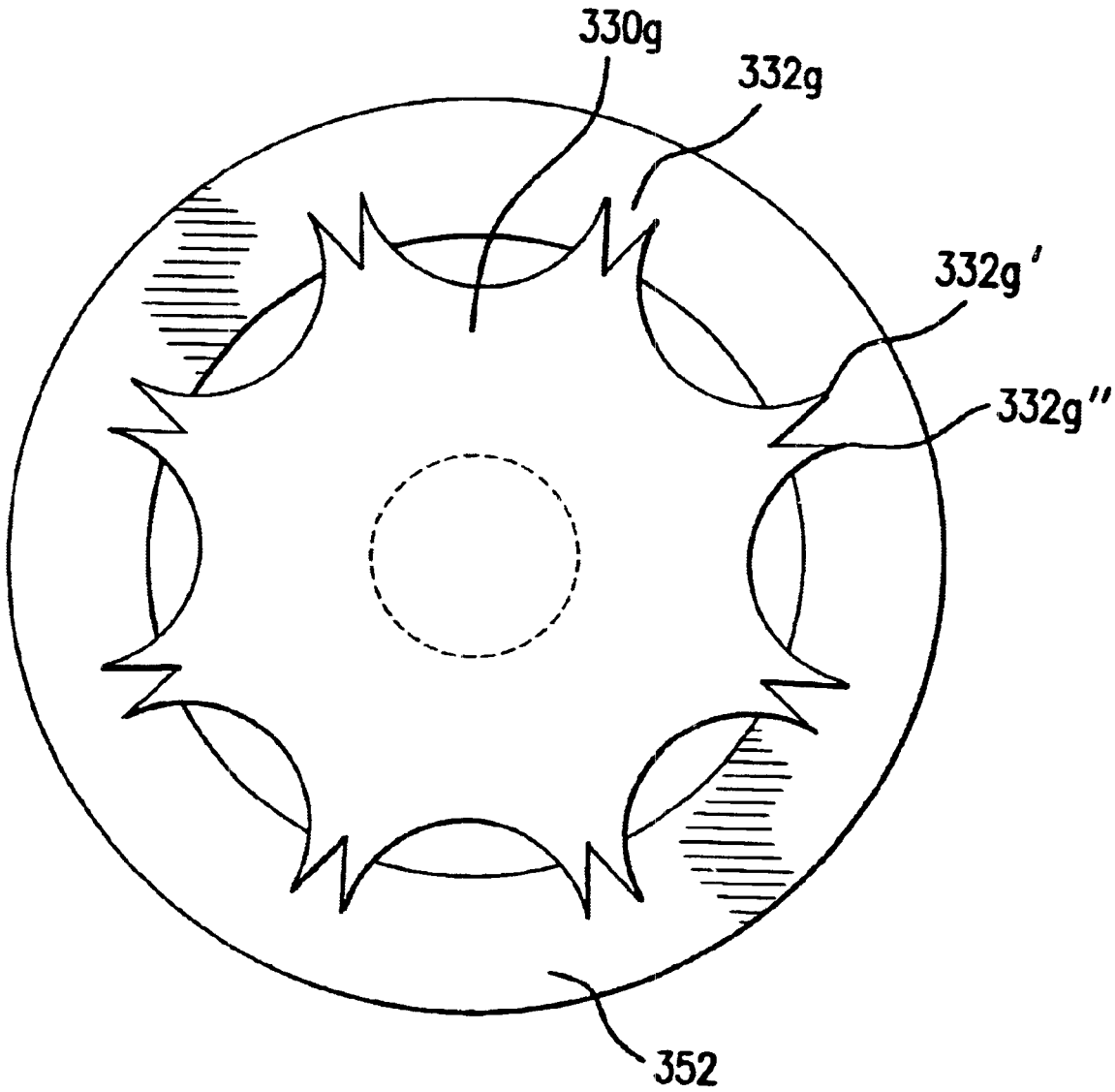
Figure 35:
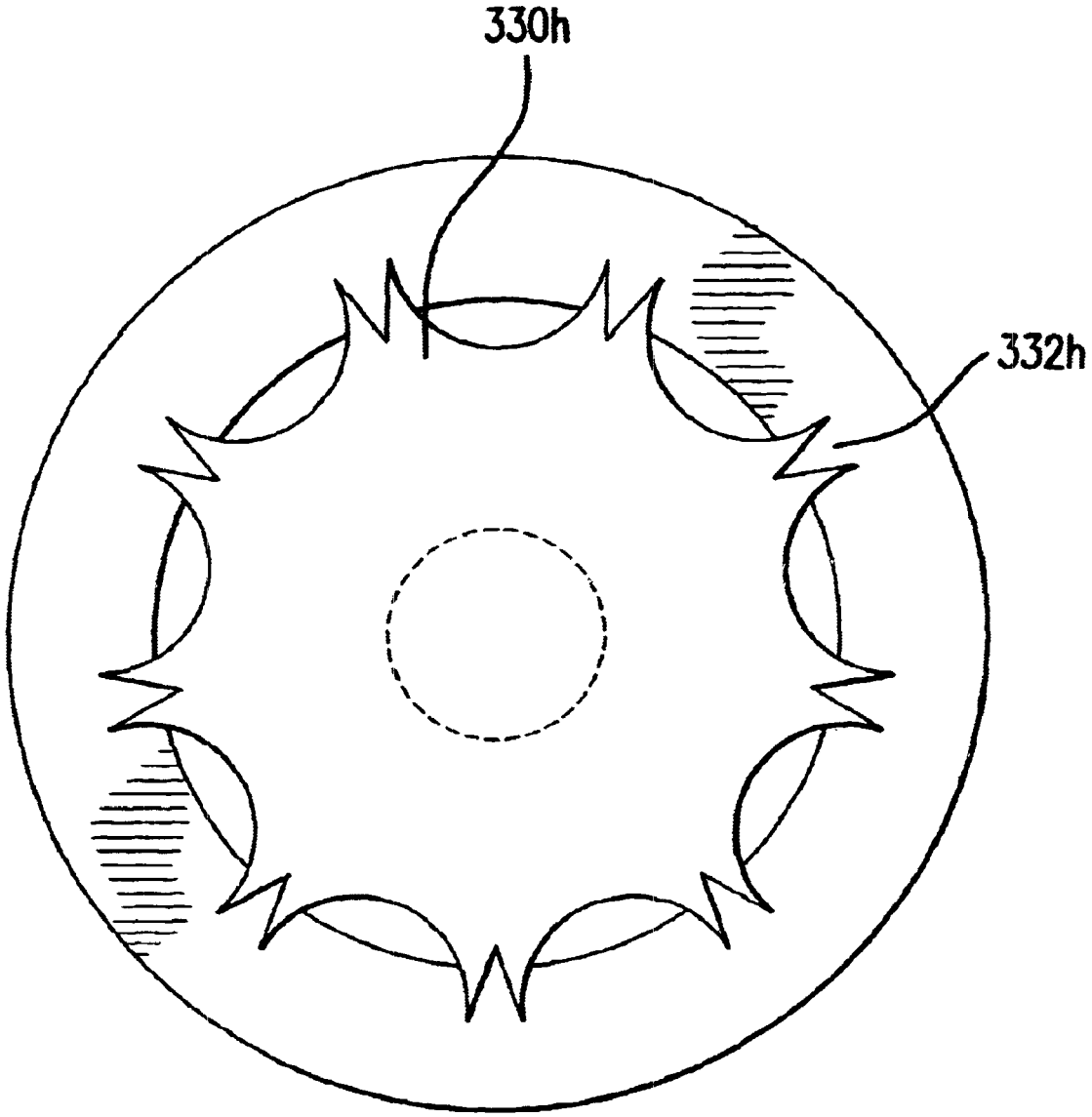
Figure 36:
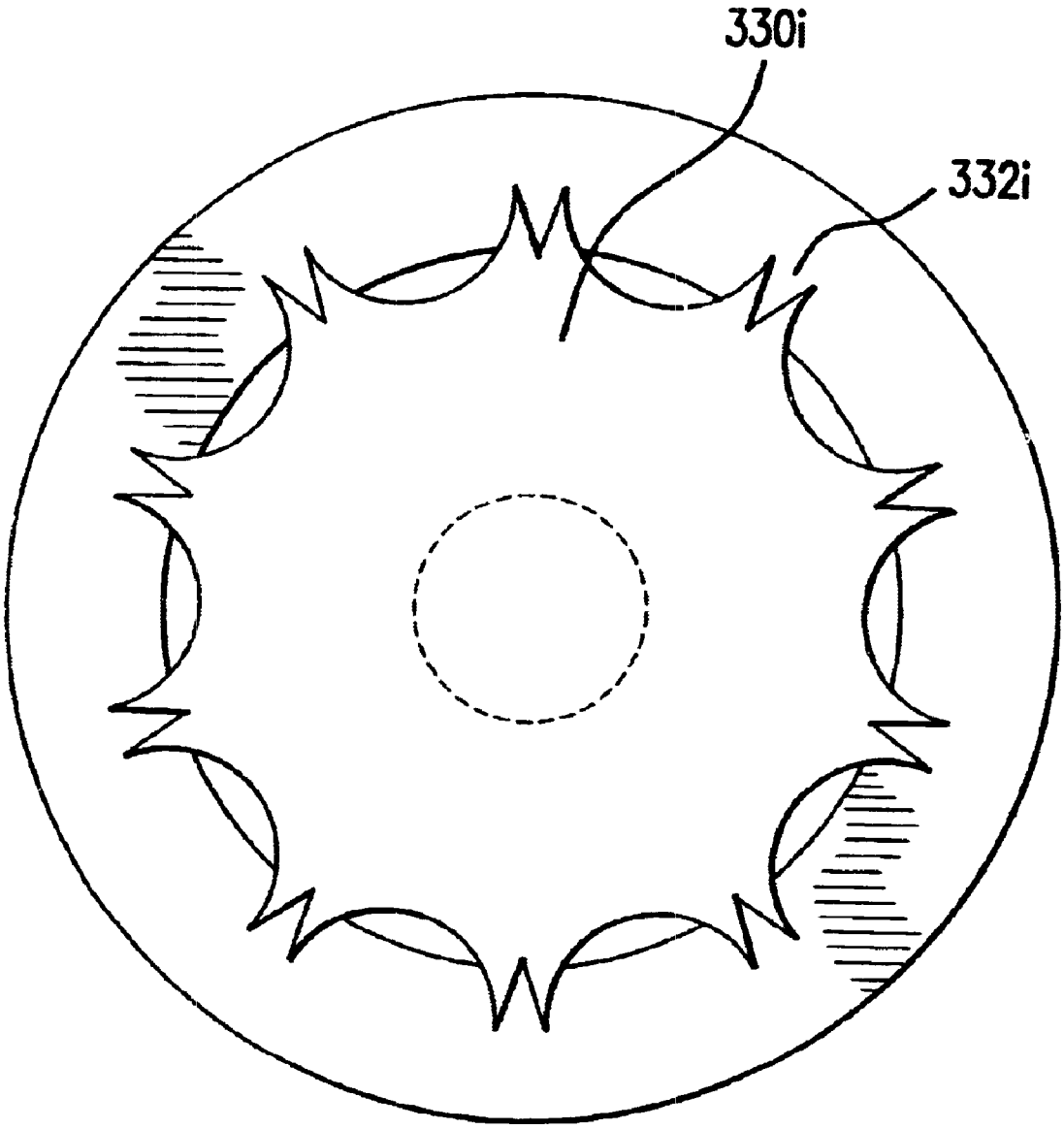
Figure 37:
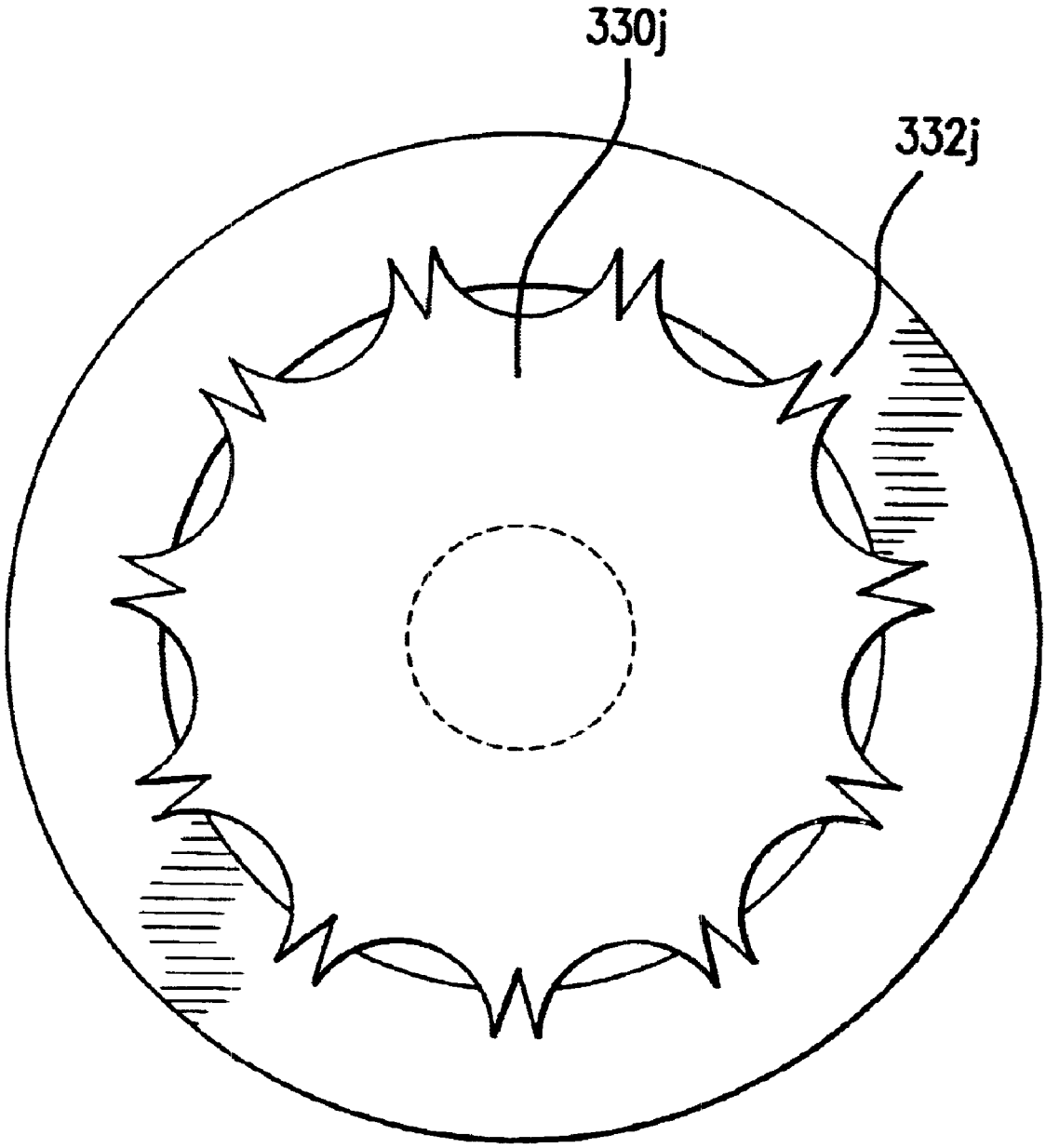
Figure 38:
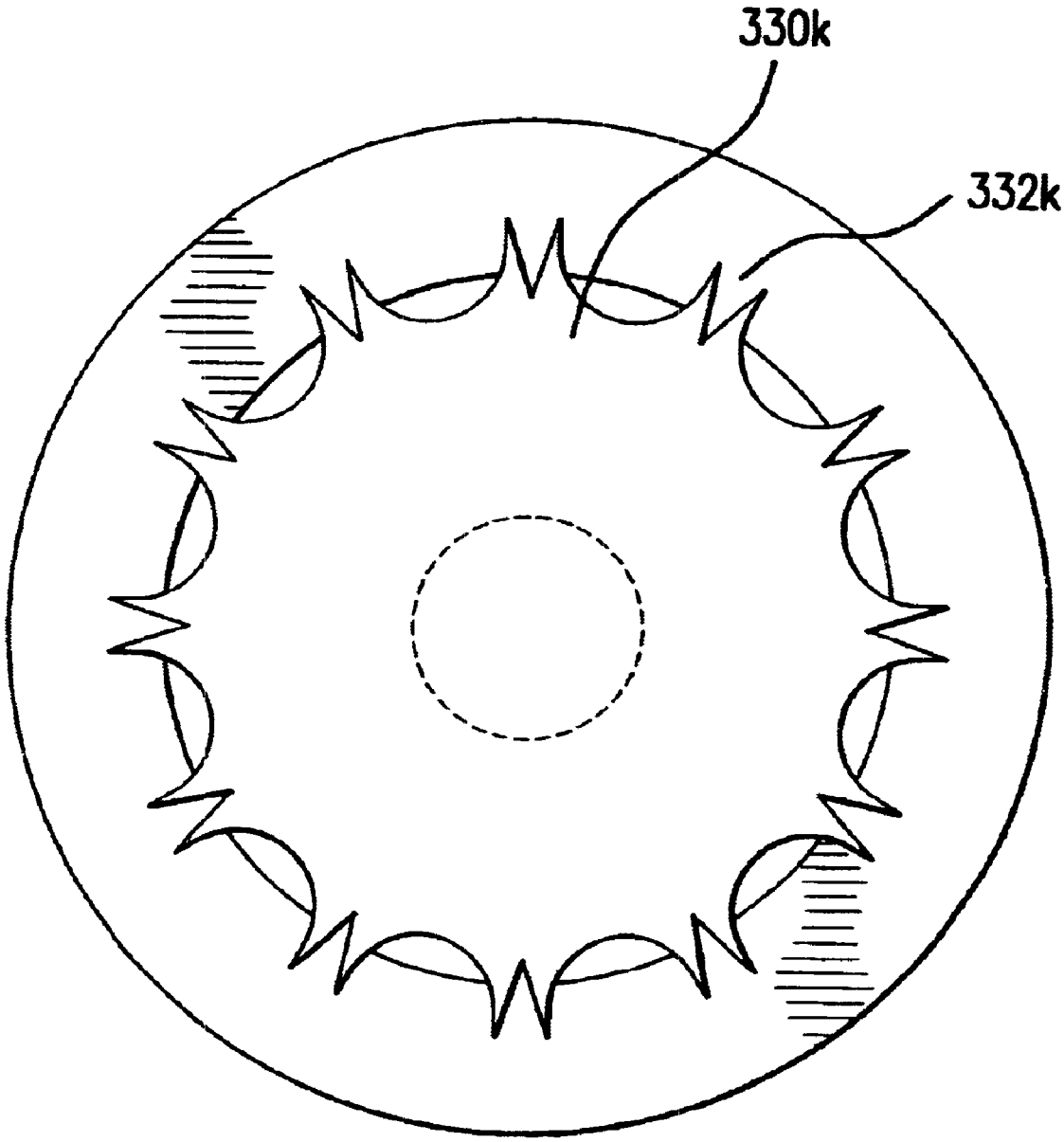
Figure 39:
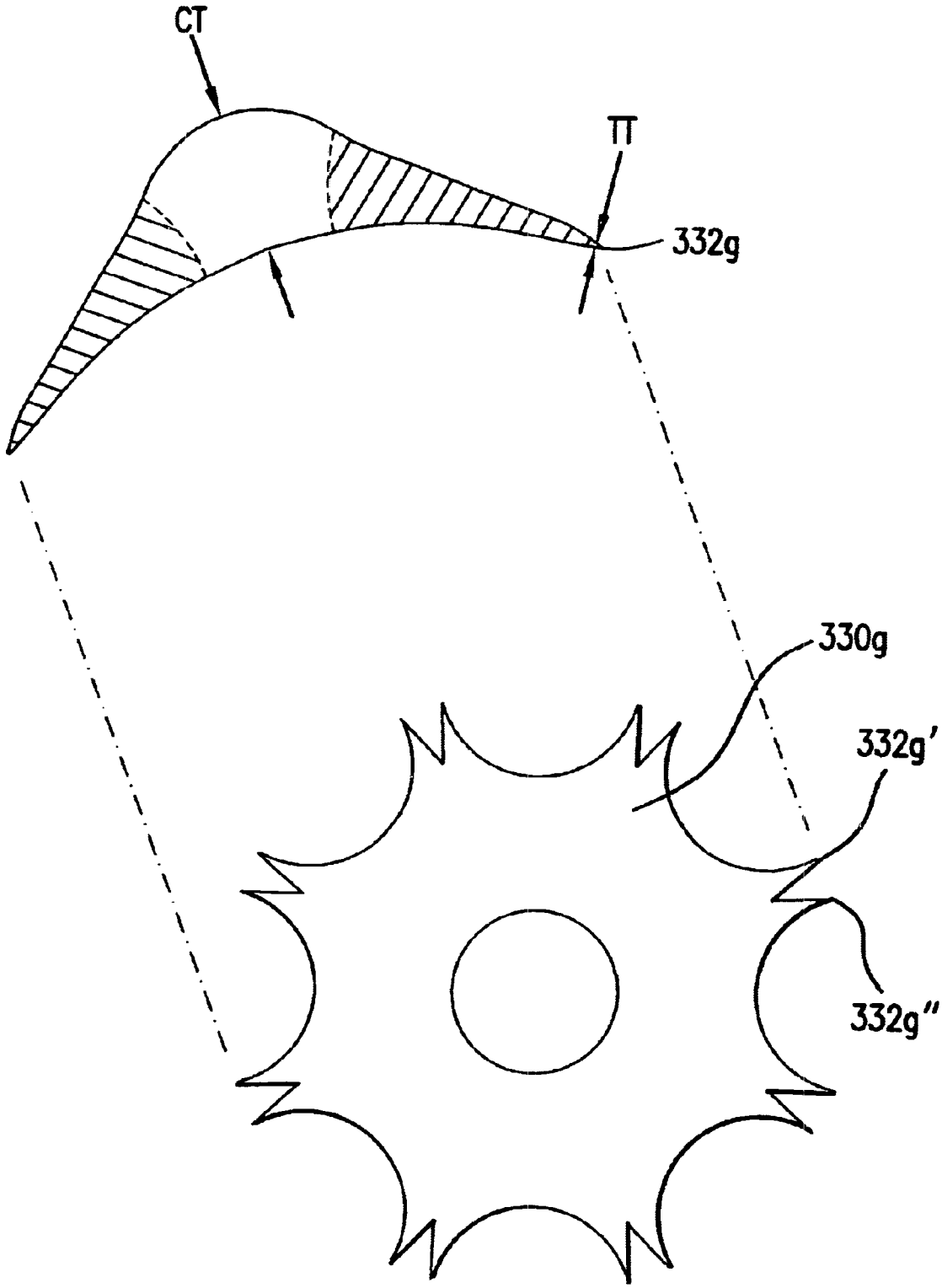
FIG. 39 is a cross-sectional view of the cap of the embodiment of FIG. 34 along the longitudinal axis of the spark plug.

Once shaped, the cap will have a central thickness, CT, and a tip thickness, TT, as shown in FIGS. 15, 27, and 39. In a preferred embodiment of the present invention, CT lies within the range 0.045 in. to 0.135 in., and TT lies within the range 0.020 in. to 0.120 in. In any given cap, CT and TT may take on any value within their respective ranges, as long as CT>TT. In this embodiment, once the desired values of CT and TT have been reached, the cap is fusion welded at its center to the proximal end 24 of the central electrode 20. Alternatively, the cap 30 and central electrode 20 may be fabricated as a single piece.

Fabricated in the manner described above, the cap 30 has a thick central dome of thickness CT, and thins out uniformly in a radial direction towards each of the tips 32, having a thickness of TT. Experiments have shown that the mass of material in the thick central dome portion of the cap 30, in combination with the use of the alloy as specified above, increases the resistivity of the cap 30 in the thick central dome portion, i.e., in the portion of the cap 30 disposed generally above the proximal end 24 of the central electrode 20. However, the resistivity drops uniformly as one moves in a radial direction towards the periphery of the cap 30. As such, when the electrical charge applied at the distal end 22 of the central electrode 20 reaches the proximal end 24, it is met with the large resistivity of the material of the central dome portion of the cap 30. As a result, the charge takes the path of least resistance, which is equally the path to each of the tips 32. In this manner, each time the spark plug 10 is operated, it substantially simultaneously generates a spark through each tip 32 of the cap 30. Again, in embodiments that employ the squared, or forked, tip, each activation of the spark plug will simultaneously generate two (2) sparks at each tip of the cap.

Given the physical structure and the material composition of the components of the instant invention, the simultaneous multi-firing property of the invention is a function of the rate of expansion of combustion within the chamber. More specifically, as sparks are generated from multiple tips on a given cap, an expanding sphere of combustion is formed. It has been found that the rate of travel, or conduction, of electrical charge from the thick central dome of the cap to the tips is faster than the rate of travel of the expanding sphere of combustion from one tip to another. As such, a spark is generated, substantially simultaneously, from each and every tip of a given cap, without being preempted by the expanding sphere of combustion.

It should also be mentioned that other elements can be added to the alloy as well. For example, a Platinum coating may be applied to the material (e.g., by dipping in a Platinum solution). It is noted, however, that such an application affects only the longevity of the alloy, leaving its electrical properties (e.g., conductivity and resistivity) unaffected. Regardless of the addition of Platinum, however, the alloy of the instant invention substantially eliminates distortion and allows the spark plug to survive, structurally, within the hostile environment of the combustion chamber.

Figure 40:
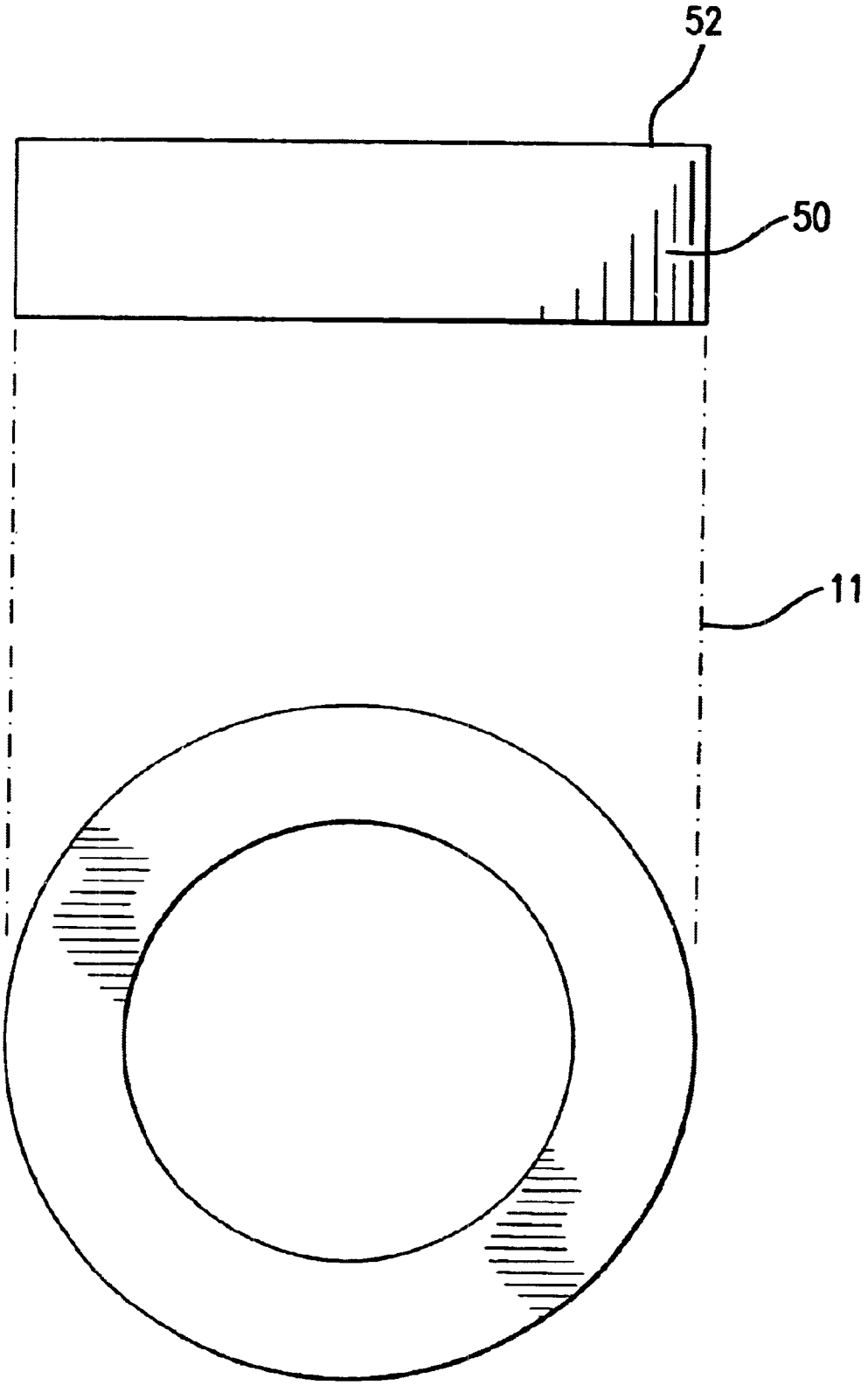
FIG. 40 shows side and top views of an embodiment of a firing ring of the invention.

FIGS. 40–43 show various embodiments of the ground collar-firing ring combination. Specifically, FIG. 40 shows an arrangement where the spark plug 10 does not contain a ground collar 40. Rather, the plug is fitted only with a firing ring 50, having a firing surface 52 and being attached to the shell 11.

Figure 41:
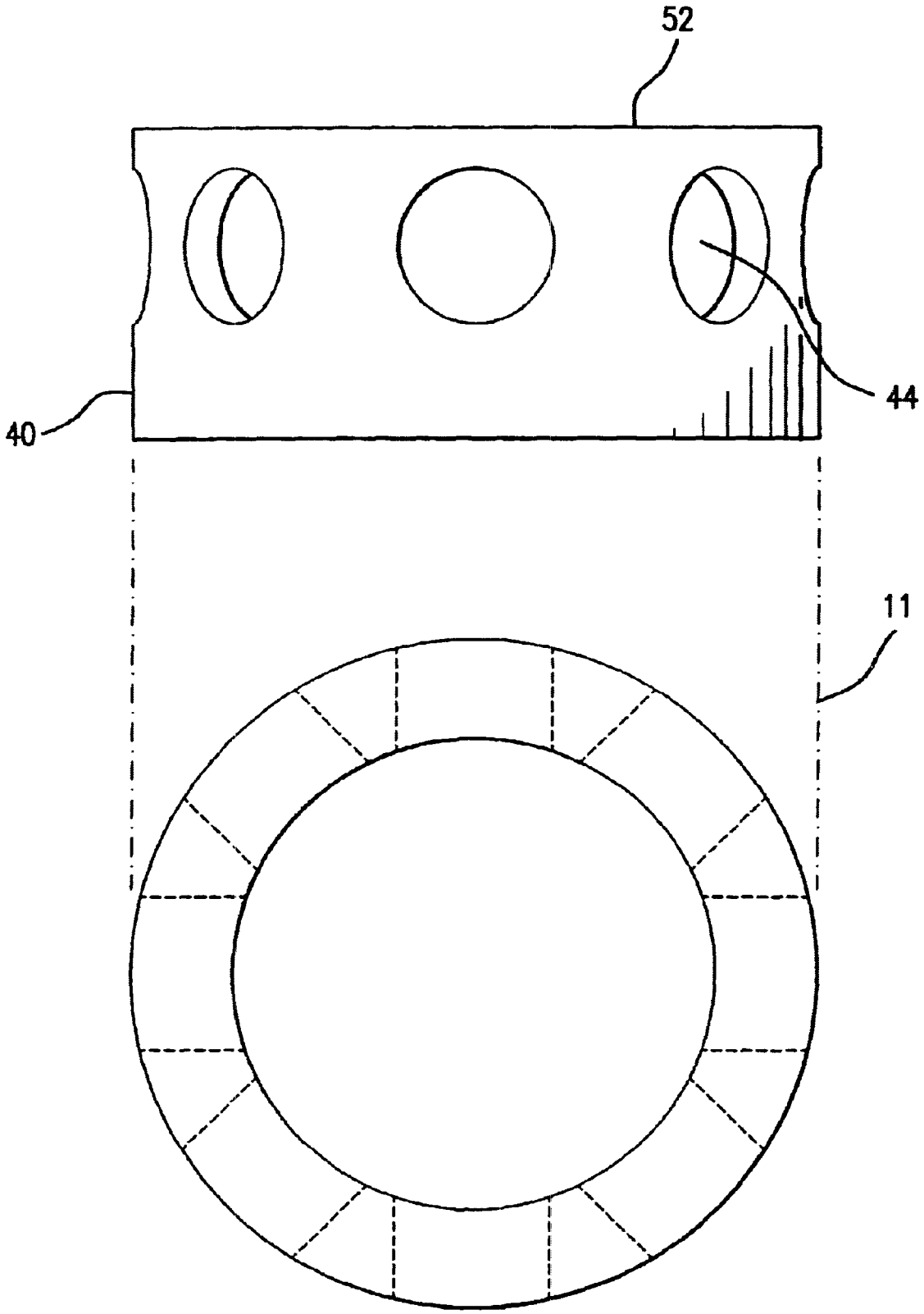
FIG. 41 shows side and top views of an embodiment of a ground collar-firing ring combination of the invention.

FIG. 41 shows a spark plug 10 having a shell 11, to which is attached a ground collar 40, as well as a firing ring 50 (not shown separately), having a firing surface 52. In addition, the ground collar 40 has defined in its annular wall a series of holes 44. In practice, the holes 44 help dissipate heat from the inner region of the spark gap G. However, more importantly for the purposes of the instant invention, it has been discovered that the holes 44 can be used to both reduce fouling of the plug and greatly enhance the dispersion of sparks in the vicinity of the proximal end of the spark plug 10 and, thus, within the combustion chamber. More specifically, for a given cap configuration, the number, shape, size, and location of the holes 44 can be manipulated in order to create a gas-flow pattern that results in a more rapid dispersion of the sparks. For example, it has been determined that, for caps having 2–5 tips, 1–5 holes, placed equidistantly around the circumference of the ground collar 40, will result in optimum performance. On the other hand, for caps having 6–12 tips, 3–9 holes, placed equidistantly around the circumference of the ground collar 40, will result in optimum performance.

Figure 42:
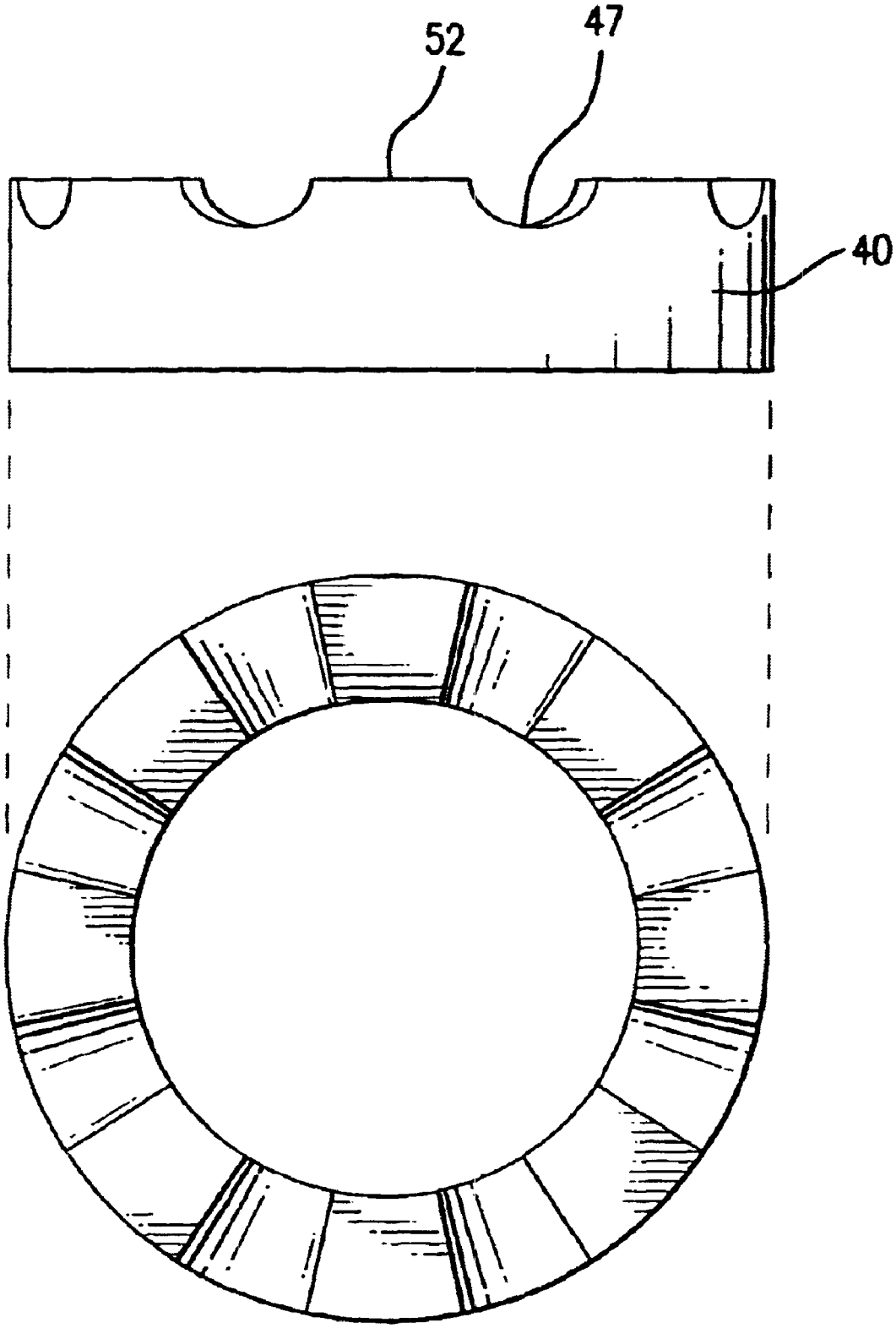
FIG. 42 shows side and top views of another embodiment of the ground collar-firing ring combination of the invention.
Figure 43:
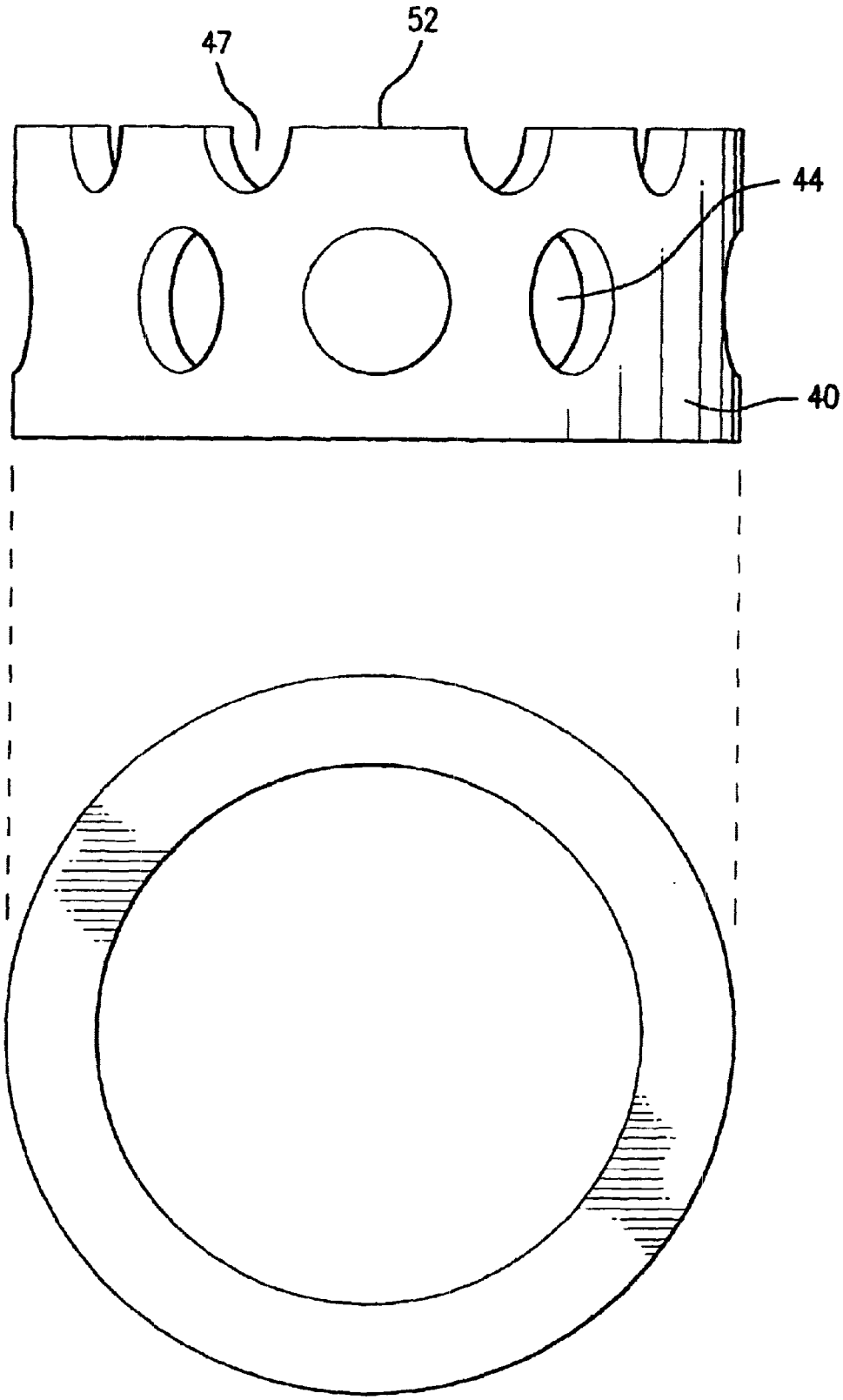
FIG. 43 shows side and top views of another embodiment of the ground collar-firing ring combination of the invention.

FIG. 42 shows yet another embodiment, wherein the ground collar-firing ring combination is in the shape of a crown. Here, no holes exist in the annular wall of the ground collar. Rather, a crown is formed by the inclusion of concavities 47, which have been shown in a semi-circular configuration for illustrative purposes, along the periphery of the firing surface 52. Similarly, FIG. 43 depicts an embodiment which contains both the holes 44 and the concavities 47. Given the spark-dispersion properties of the holes 44 and concavities 47, as discussed previously, the specific use of each of the collar-ring embodiments disclosed herein will depend on the specific application. For example, the embodiment of FIG. 43 is best suited to smaller engines, wherein an increased number of flowpaths (i.e., the number of holes 44 enhanced by the number of concavities 47) can be used to achieve a desired level of spark dispersion in the smaller operating volume of a smaller engine cylinder. In general, configurations in which the holes and/or the concavities constitute between about 20% and 40% of the total surface area of the ground collar-firing ring combination have been found to be advantageous.

It is important to note that the dimensions of the ground collar-firing ring combination also play a significant role in the practical and successful operation of the instant invention. As was mentioned previously, it has been determined that the outer diameter of the cap 30 (i.e., at the tips 32) must be such that it overlaps the firing surface 52 of the firing ring 50 by ⅓ to ½, i.e., such that the tips 32 fall within the inner ⅓ to ½ of the wall thickness of the ground collar-firing ring combination. In this regard, experiments have shown that a wall thickness, for the combination, of less than about ⅛ in. may cause the spark plug to fail, given the operating conditions of the combustion chamber.

In addition, the following dimensions have been shown to be optimal for the inner diameter (ID) and outer diameter (OD) of the ground collar-firing ring combination. For a 10 mm plug, an ID of 3⁄16 in. and an OD of 5⁄16 in.; for a 12 mm plug, an ID of ¼ in. and an OD of ⅜ in.; for a 14 mm plug, an ID of 5⁄16 in. and an OD of 7⁄16 in.; and for a 16 mm plug, an ID of ⅜ in. and an OD of ½ in. Moreover, the longitudinal length of the ground collar-firing ring combination can be used for optimal positioning of the gap G within the combustion chamber.

Although several embodiments have been described herein, one skilled in the art will understand that there are equivalent alternative embodiments. For example, although the holes and concavities of the ground collar depicted in FIGS. 41–43 have been shown as being of a circular, and semi-circular, cross-section respectively, other geometries may also be used. As such, it is not intended that the invention be limited to the disclosed embodiments, or to the details thereof, and departures may be made therefrom within the spirit and scope of the invention as defined by the claims.

What is claimed is:

1. A spark plug comprising:

(a) a central electrode having a distal end and a proximal end;

(b) an insulator surrounding the central electrode;

(c) a shell surrounding the insulator;

(d) a cylindrical extension attached to the shell, the extension having a proximal firing surface and defining a plurality of holes in the cylindrical wall thereof; and (e) a cap attached to the proximal end of said central electrode and having a plurality of projections protruding radially from the periphery thereof, wherein:

the central electrode, the insulator, and the shell are disposed in a concentric arrangement and the cap is concave;

the cylindrical extension and the cap are spaced apart to define a spark gap between said firing surface of the extension and said projections on the periphery of the cap; and the cylindrical extension is configured such that said holes comprise between about 20% and 40% of the total surface area of said wall of said cylindrical extension.

2. The spark plug of claim 1, wherein the outer diameter of the cap is smaller than the outer diameter of the cylindrical extension.

3. The spark plug of claim 2, wherein the cap is configured such that the radially-outermost end of each projection falls within the inner ⅓ to ½ of the wall thickness of the cylindrical extension.

4. The spark plug of claim 1, wherein said cap has between 2 and 5 projections and the cylindrical extension has between 1 and 5 holes, said holes being placed substantially equidistantly around the circumference of the extension.

5. The spark plug of claim 1, wherein said cap has between 6 and 12 projections and the cylindrical extension has between 3 and 9 holes, said holes being placed substantially equidistantly around the circumference of the extension.

6. The spark plug of claim 1, wherein said proximal firing surface of the cylindrical extension defines a plurality of concavities along the periphery thereof, said firing surface being configured in the shape of a crown.

7. The spark plug of claim 6, wherein the holes are circular, and said concavities are semi-circular, in cross-section.

8. A spark plug comprising:

(a) a central electrode having a distal end and a proximal end;

(b) an insulator surrounding the central electrode;

(c) a shell surrounding the insulator;

(d) a cylindrical extension attached to the shell; and (e) a cap attached to the proximal end of said central electrode and having a plurality of projections protruding radially from the periphery thereof, wherein:

the central electrode, the insulator, and the shell are disposed in a concentric arrangement;

the cap is concave; and the central electrode, the cylindrical extension, and the cap are made of an alloy comprising:

0.18–0.21% by weight Aluminum, 0.001–0.004% by weight Boron, 0.210–0.220% by weight Titanium, 1.0–1.25% by weight Molybdenum, 1.30–1.50% by weight Manganese, 0.60–0.75% by weight Silicon, 0.05–0.08% by weight Carbon, 25.0–26.0% by weight Nickel, 0.20–0.30% by weight Vanadium, and 69.69–71.46% by weight Iron.

9. The spark plug of claim 8, wherein the cylindrical extension is a firing ring having a firing surface.

10. The spark plug of claim 8, wherein said alloy has a Brinell Hardness Number within the range of 190 to 225.

11. The spark plug of claim 9, wherein the cylindrical extension has a proximal firing surface defining a plurality of concavities along the periphery thereof, said firing surface being configured in the shape of a crown.

12. The spark plug of claim 11, wherein said concavities are semi-circular in cross-section.

13. A spark plug comprising:

(a) a central electrode having a distal end and a proximal end;

(b) an insulator surrounding the central electrode;

(c) a shell surrounding the insulator;

(d) a cylindrical extension attached to the shell, the extension having a proximal firing surface; and (e) a cap attached to the proximal end of said central electrode and having a plurality of projections protruding radially from the periphery thereof, wherein:

the central electrode, the insulator, and the shell are disposed in a concentric arrangement and the cap is concave, the cap having a central dome portion that is more massive than any other part of said cap, and being configured so as to become uniformly thinner in a direction radially away from the central dome portion and towards said projections;

the cylindrical extension and the cap are spaced apart to define a spark gap between said firing surface of the extension and said projections on the periphery of the cap; and the central electrode, the cylindrical extension, and the cap are made of an alloy comprising:

0.18–0.21% by weight Aluminum, 0.001–0.004% by weight Boron, 0.210–0.220% by weight Titanium, 1.0–1.25% by weight Molybdenum, 1.30–1.50% by weight Manganese, 0.60–0.75% by weight Silicon, 0.05–0.08% by weight Carbon, 25.0–26.0% by weight Nickel, 0.20–0.30% by weight Vanadium, and 69.69–71.46% by weight Iron.

14. The spark plug of claim 13, further defining a plurality of holes in the wall of said cylindrical extension, the cylindrical extension being configured such that said holes comprise between about 20% and 40% of the total surface area of said wall of said cylindrical extension.

15. The spark plug of claim 14, wherein the proximal firing surface of said cylindrical extension defines a plurality of concavities along the periphery thereof, said firing surface being configured in the shape of a crown.

* * * * *